US007422720B1

(12) United States Patent
Wei et al.

(10) Patent No.: US 7,422,720 B1
(45) Date of Patent: Sep. 9, 2008

(54) HIGH DENSITY NONTOXIC PROJECTILES AND OTHER ARTICLES, AND METHODS FOR MAKING THE SAME

(75) Inventors: Tim T. Wei, Irvine, CA (US); Luguang Tian, Shandong (CN)

(73) Assignee: Spherical Precision, Inc., Irvine, CA (US)

( * ) Notice: Subject to any disclaimer, the term of this patent is extended or adjusted under 35 U.S.C. 154(b) by 554 days.

(21) Appl. No.: 11/126,995

(22) Filed: May 10, 2005

Related U.S. Application Data

(60) Provisional application No. 60/569,793, filed on May 10, 2004.

(51) Int. Cl.
*B22F 1/00* (2006.01)
*B22F 1/02* (2006.01)

(52) U.S. Cl. ..... 419/32; 75/246; 102/448; 102/517

(58) Field of Classification Search ..... 419/32
See application file for complete search history.

(56) References Cited

U.S. PATENT DOCUMENTS

| | | | |
|---|---|---|---|
| 1,847,617 | A | 3/1932 | Lowenstein et al. |
| 2,105,528 | A | 1/1938 | Foisy |
| 2,119,876 | A | 6/1938 | Corson |
| 2,183,359 | A | 12/1939 | Smithells |
| 2,409,307 | A | 10/1946 | Patch et al. |
| 2,442,155 | A | 5/1948 | Weese |
| 2,919,471 | A | 1/1960 | Hechinger |
| 2,995,090 | A | 8/1961 | Daubenspeck |
| 3,123,003 | A | 3/1964 | Lang, Jr. et al. |
| 3,363,561 | A | 1/1968 | Irons |
| 3,372,021 | A | 3/1968 | Forbes et al. |
| 3,623,849 | A | 11/1971 | Benjamin |
| 3,785,801 | A | 1/1974 | Benjamin |
| 3,888,636 | A | 6/1975 | Sczerzenie et al. |
| 3,890,145 | A | 6/1975 | Hivert et al. |
| 3,898,933 | A | 8/1975 | Castera et al. |
| 3,946,673 | A | 3/1976 | Hayes |
| 3,953,194 | A | 4/1976 | Hartline, III et al. |

(Continued)

FOREIGN PATENT DOCUMENTS

| | | |
|---|---|---|
| GB | 2149067 | 6/1985 |

(Continued)

OTHER PUBLICATIONS

Office Action in U.S. Appl. No. 11/126,523, mailed on Mar. 20, 2007.

(Continued)

*Primary Examiner*—Roy King
*Assistant Examiner*—Weiping Zhu
(74) *Attorney, Agent, or Firm*—Knobbe Martens Olson & Bear LLP

(57) ABSTRACT

High density, nontoxic projectiles and other articles, and their methods of manufacture, are disclosed. More particularly, high density nontoxic W—Cu—Ni—Fe alloy compositions, methods of their manufacture and methods by which they may be used as projectiles such as shots, bullets, and pellets and other products traditionally made of lead alloys will be detailed herein in some embodiments. These products have a density comparable to that of lead while avoiding problems of toxicity associated with the use of lead.

32 Claims, 57 Drawing Sheets

U.S. PATENT DOCUMENTS

| | | | |
|---|---|---|---|
| 3,979,234 | A | 9/1976 | Northcutt, Jr. et al. |
| 4,005,660 | A | 2/1977 | Pichard |
| 4,027,594 | A | 6/1977 | Olin et al. |
| 4,035,115 | A | 7/1977 | Hansen |
| 4,035,116 | A | 7/1977 | O'Brien et al. |
| 4,138,249 | A | 2/1979 | Rosof |
| 4,252,577 | A | 2/1981 | Malard |
| 4,274,940 | A | 6/1981 | Plancqueel et al. |
| 4,338,126 | A | 7/1982 | Vanderpool et al. |
| 4,383,853 | A | 5/1983 | Zapffe |
| 4,428,295 | A | 1/1984 | Urs |
| 4,488,959 | A | 12/1984 | Agar |
| 4,603,637 | A | 8/1986 | Snide et al. |
| 4,621,011 | A | 11/1986 | Fleischer et al. |
| 4,643,099 | A | 2/1987 | Luther et al. |
| 4,760,794 | A | 8/1988 | Allen |
| 4,762,559 | A | 8/1988 | Penrice et al. |
| 4,780,981 | A | 11/1988 | Hayward et al. |
| 4,784,690 | A | 11/1988 | Mullendore |
| 4,850,278 | A | 7/1989 | Dinkha et al. |
| 4,881,465 | A | 11/1989 | Hooper et al. |
| 4,897,117 | A | 1/1990 | Penrice |
| 4,931,252 | A | 6/1990 | Brunisholz et al. |
| 4,939,996 | A | 7/1990 | Dinkha et al. |
| 4,940,404 | A | 7/1990 | Ammon et al. |
| 4,949,644 | A | 8/1990 | Brown |
| 4,949,645 | A | 8/1990 | Hayward et al. |
| 4,958,572 | A | 9/1990 | Martel |
| 4,960,563 | A | 10/1990 | Nicolas |
| 4,961,383 | A | 10/1990 | Fishman et al. |
| 4,990,195 | A | 2/1991 | Spencer et al. |
| 5,000,783 | A | 3/1991 | Dingemon et al. |
| 5,069,869 | A | 12/1991 | Nicolas et al. |
| 5,072,944 | A | 12/1991 | Nakahara et al. |
| 5,088,415 | A | 2/1992 | Huffman et al. |
| H1235 | H | 10/1993 | Canaday |
| 5,264,022 | A | 11/1993 | Haygarth et al. |
| 5,279,787 | A | 1/1994 | Oltrogge |
| 5,399,187 | A | 3/1995 | Mravic et al. |
| 5,464,465 | A | 11/1995 | Avotins et al. |
| 5,527,376 | A | 6/1996 | Amick et al. |
| 5,713,981 | A | 2/1998 | Amick |
| 5,719,352 | A | 2/1998 | Griffin |
| 5,740,516 | A | 4/1998 | Jiranek, II et al. |
| 5,747,724 | A | 5/1998 | Lindgren et al. |
| 5,760,331 | A | 6/1998 | Lowden et al. |
| 5,774,780 | A | 6/1998 | Prause |
| 5,786,416 | A | 7/1998 | Gardner et al. |
| 5,814,759 | A | 9/1998 | Mravic et al. |
| 5,820,707 | A | 10/1998 | Amick et al. |
| 5,831,188 | A | 11/1998 | Amick et al. |
| 5,847,313 | A | 12/1998 | Beal |
| 5,868,879 | A | 2/1999 | Amick et al. |
| 5,877,437 | A | 3/1999 | Oltrogge |
| 5,905,936 | A | 5/1999 | Fenwick et al. |
| 5,913,256 | A | 6/1999 | Lowden et al. |
| 5,917,143 | A | 6/1999 | Stone |
| 5,922,978 | A | 7/1999 | Carroll |
| 5,950,064 | A | 9/1999 | Robinson et al. |
| 5,963,776 | A | 10/1999 | Lowden et al. |
| 6,048,379 | A | 4/2000 | Bray et al. |
| 6,090,178 | A | 7/2000 | Benini |
| 6,112,669 | A | 9/2000 | Mravic et al. |
| 6,136,105 | A | 10/2000 | Spencer |
| 6,209,180 | B1 | 4/2001 | Amick |
| 6,248,150 | B1 | 6/2001 | Amick |
| 6,258,316 | B1 | 7/2001 | Buenemann, Jr. et al. |
| 6,270,549 | B1 | 8/2001 | Amick |
| 6,371,029 | B1 | 4/2002 | Beal |
| 6,447,715 | B1 | 9/2002 | Amick |
| 6,457,417 | B1 | 10/2002 | Beal |
| 6,497,746 | B1 | 12/2002 | Steeghs et al. |
| 6,527,824 | B2 | 3/2003 | Amick |
| 6,527,880 | B2 | 3/2003 | Amick |
| 6,551,376 | B1 | 4/2003 | Beal |
| 6,581,523 | B2 | 6/2003 | Beal |
| 6,591,730 | B2 | 7/2003 | Beal |
| 6,823,798 | B2 | 11/2004 | Amick |
| 2003/0161751 | A1 | 8/2003 | Elliott |

FOREIGN PATENT DOCUMENTS

| | | |
|---|---|---|
| WO | WO 96/11762 | 4/1996 |
| WO | WO 97/27447 | 7/1997 |
| WO | WO 01/06203 | 1/2001 |

OTHER PUBLICATIONS

Pietsch, Wolfgang, "Agglomeration Processes, Phenomema, Technology, Equipment," Wiley-VCH Verlag GMbH, Weinheim, 2002, p. 43-36, p. 58-60, p. 153-160.

"Lyman's Shotshell Reloading Handbook," 4th Edition, p. 60-61, p. 98-103, p. 308-313.

Laycock, George, "The Shotgunner's Bible," Revised Edition 1987, p. 50-52.

On line http://en.wikipedia.lorg/wiki/Fluid_dynamics (printed Jan. 3, 2005) dated Feb. 7, 2005.

Beddow, John Keith, "The Production of Metal Powders by Atomization", Hewyden & Son Ltd., 1978.

Dec. 2003 sale of shipment of shots by the assignee Spherical Precision, Inc. containing shots having diameters of 0.100", 0.110", 0.120", 0.130", 0.150" and 0.180".

HIGH DENSITY NONTOXIC PROJECTILES AND OTHER ARTICLES, AND METHODS FOR MAKING THE SAME

CROSS-REFERENCE TO RELATED APPLICATION

This application claims the benefit of U.S. Provisional Application No. 60/569,793, filed May 10, 2004, the entirety of which is hereby incorporated by reference.

BACKGROUND OF THE INVENTION

1. Field of the Invention

This invention relates in certain embodiments to high density, nontoxic articles such as shots used as projectiles in shotgun shells and the like.

2. Description of the Related Art

Lead has traditionally been used as a material for shot pellets for hunting, especially hunting for birds, because of its high density and low melting point that lend itself to ease of manufacture and highly predictable ballistic characteristics. The majority of these pellets fall to the ground without hitting the target. Some of them settle on the bottom of the wetlands and lakes. Over time the spent lead pellets accumulate to a point that some waterfowl have shown signs of lead poisoning because they ingested lead pellets while in search of food and also the grit to assist in digestion of the food. This has led to the ban of lead shot pellets for waterfowl hunting in the U.S., Canada, and other countries.

Because of market demand, considerable effort has been devoted to searching for a viable lead substitute that can be economically produced and at the same time possesses the predictable ballistic characteristics of the lead shot pellet, such as uniform pattern density with a wide variety of shotgun chokes and barrel lengths, and uniform muzzle velocities with various smokeless powders. There are no comparable metals that possess all of the desired characteristics. Those metals that are somewhat close to lead in density are not satisfactory substitutes as a result of other drawbacks, such as high cost, radioactivity, high melting point, or other properties.

Various approaches have been proposed to formulate a mixture of metals and in some cases using polymers. Additionally, various methods have been attempted to process these mixtures for the final product. Despite these prior efforts, the products made according to these materials and processes have some shortcomings as discussed below.

Steel was selected as the most practical substitute, based on methods of production, cost, ballistics, and its nontoxic nature. However, steel shot pellets have a density of about 7.5 to about 8.0 g/cm$^3$ as compared to lead alloy shot pellets which have a density of about 10 to about 11 g/cm$^3$. Density differences between shots of the same gauge will perform differently in the trajectory and firearm recoil when powered by the same charge. Additionally, steel shot pellets do not deform, and have a definite tendency toward center density regardless of choke. Especially for the large size steel shots, they do not pattern perfectly from tightly choked barrels because such charges do not swage down well to flow smoothly through the choke. The wedging and bridging were believed to be the reasons in an overly choked condition. To compensate for the density difference, hunters have been using two or three larger gauge shot pellets in the shotshell load. Unfortunately, the larger shot pellet size reduces the total number of shot pellets that can be loaded in the predefined shotshell case; this in turn deteriorates the pattern density. Because of the hardness of the steel shot pellet, it is required to have a thicker and harder plastic to protect the bore from the ravages of the steel shot pellets. This requirement further reduces the case volume available for the shot pellets. In order to increase the case volume to accommodate more steel shot pellets, the wad has been redesigned to eliminate the collapsible leg section.

The larger diameter steel shot pellets suffer more disadvantages. The larger steel shot pellet will lose velocity quicker than the smaller high density shots. Also, the steel shot pellet will not penetrate as well because of its larger frontal section. This, coupled with low density, loss of velocity due to drag force, and the inferior pattern density previously mentioned, have resulted in an increased number of crippling shots. Hunters have been known to reduce the range over which he or she will try to take game by as much as 25%. Also, because the steel shot pellets lose momentum over the flight range, they require a lengthened lead. Some manufacturers have employed special powder to drive up the muzzle velocity, but these powders also increase the barrel pressure which causes safety concerns. All of these issues cause a great deal of confusion and frustration to the hunting community.

Nontoxic shot products currently in the market are either too hard or too soft, too frangible or too rigid, or too abrasive. Products that are too hard or too rigid damage the gun barrel and have a strong tendency to ricochet when hitting a hard surface. Products that are too soft tend to leave some rub off particles in the gun barrel and deform too much at firing and in flight, which causes deterioration in the shot pattern and final impact energy and energy transfer. It is also harder for a soft shot to penetrate the animal to make a clean kill. Products that are too frangible tend to crack during set back (firing), and in flight; this will cause drag in flight and cause the shot to lose momentum. It also tends to cause the shot to disintegrate upon impact, thus impeding penetration and causing the energy to not transfer onto the animal.

The majority of the prior nontoxic shots have not proved to be commercially viable primarily due to high equipment cost, high process operating cost, inferior density and hardness characteristics compared to lead and lead alloy.

SUMMARY OF THE INVENTION

One embodiment of the present invention is a nontoxic shot for various applications. The shot preferably contains tungsten, and may be a sintered nontoxic shot pellet for ammunition with high accuracy in specific gravity and tight tolerance in size. Preferably, the shot is made using a mechanical agitation or tumbling process, to produce precise control over the size and sphericity of the shot, while also maintaining a high density and relatively low hardness. In one embodiment, the shot has a density of at least 10 g/cm$^3$, and a Vickers hardness HV of about 230 or less.

Another embodiment of the present invention is a composition for a shot that varies throughout the cross section of the shot, and also in a precise manner. In one embodiment, a sintered shot has a predetermined transition of density and transition of hardness reading at different layers/depths of the shot. More preferably, a sintered high density shot is provided containing tungsten and having a predetermined combination of size tolerance, accuracy in each layer's density, and accuracy in aggregate density. In one example having three distinct layers, the surface hardness measured at near the shot's generally spherical surface measures about HV 200 or lower, more preferably about HV 100 or lower, and the core hardness measures about HV 200 or lower, more preferably about HV 110 or lower.

After a shot is formed, a tin coating may optionally be plated or hot dipped on the outer surface of the shot.

In accordance with preferred embodiments of the invention, multiple variations in material can be used to form a spherical shot. For example, a single layer shot may be formed, with or without an additional tin coating. In another example, a dual layer shot may be formed, having a core and an outer layer, with or without an additional tin coating on the outer surface of the outer layer. In another example, a three layer shot may be formed, having a core, an intermediate layer, and a surface layer. This three layer shot may have varying hardness and/or density between the layers, and may or may not have a tin coating on the outer surface of the surface layer.

In one embodiment, an ammunition projectile is provided comprising a first component comprising tungsten, and a second component comprising at least one of copper, iron and nickel. The projectile has a density of at least 10 g/cm$^3$ and a Vickers hardness HV of about 230 or less. In a preferred embodiment, the ammunition projectile comprises primarily tungsten, and is uniformly layered and sintered. The second component may comprise copper, iron and nickel. The projectile may be made by mechanical agitation, and may be spherical, with a ball diameter variation of about 0.0068" or less. The density of the projectile may be about 10 to 15.5 g/cm$^3$, and may have a diameter suitable for use as a shot in a shotgun shell.

In another embodiment, an ammunition projectile comprises powder components comprising tungsten and at least one of copper, iron and nickel, and a binder. The powder components are bound by the binder, grown in layers and sintered to form a sphere. In one embodiment, the sphere has a substantially uniform ball diameter variation, such as about 0.0068" or less. The powder components may comprise primarily tungsten, and copper, iron and nickel. The sphere may have a density of about 10 to 16 g/cm$^3$, more preferably about 10 to 13.5 g/cm$^3$. The projectile may be a shot suitable for use in a shotgun shell, and may have a diameter from about 0.05" to about 0.36", more preferably from 0.070" to 0.220".

In another embodiment, a lot of ammunition projectiles is provided. The lot comprises a plurality of spherical shots, each shot comprising a first component comprising tungsten, and a second component comprising at least one of copper, iron and nickel. The first and second components are bound together with a binder and sintered to form the shots. The shots comprise uniformly grown layers, and the plurality of spherical shots have a lot diameter variation of about 0.01" or less. In other embodiments, the lot diameter variation may be about 0.008" or less, about 0.006" or less, or even about 0.005" or less. Each spherical shot may have a density of about 10 to 16 g/cm$^3$, more preferably about 10 to 13.5 g/cm$^3$. Each spherical shot may have the same diameter in the range of 0.070" to 0.220".

In another embodiment, an ammunition projectile having a desired aggregate density is provided. The projectile comprises a plurality of layers of different compositions, the plurality of layers including a relatively soft surface layer and a relatively hard section within the surface layer. The desired aggregate density is in the range of about 9 to 16 g/cm$^3$. The projectile may be spherical, and the plurality of layers may be concentrically arranged. The relatively hard section within the surface layer may be a core, or may be an intermediate layer, further comprising a relatively soft core. The surface layer may have a density of between about 8 and 10 g/cm$^3$, and the core may have a density of between about 8 and 10 g/cm$^3$. The relatively hard section may have a density of between about 11 and 18 g/cm$^3$. The desired aggregate density may be in the range of about 9.4 and 15 g/cm$^3$. In one embodiment, the relatively hard section has a hardness of between about HV 200 and HV 270 and the surface layer has a hardness of about HV 200 or lower. In one embodiment, the core and surface layer have a hardness of about HV 200 or lower and the intermediate layer has a hardness between about HV 200 and HV 270. The projectile may be substantially lead free, and the surface layer may comprise primarily iron and the relatively hard section may comprise primarily tungsten. The projectile may be spherical and form a shot suitably sized for use in a shotgun shell.

In another embodiment, a method of making an ammunition projectile having a predetermined aggregate density is provided. One or more constituents is selected in powdered form having a density substantially higher than the predetermined aggregate density. One or more constituents is selected in powdered form having a density substantially lower than the predetermined aggregate density. In combination, the constituents having densities substantially higher and substantially lower than the predetermined aggregate density provide an aggregate density substantially equal to the predetermined aggregate density. The powdered constituents are agitated with a binding agent to cause the powdered constituents to form pellets. The pellets are sintered to form projectiles having substantially the predetermined aggregate density.

The powdered constituents having a density substantially higher than the predetermined aggregate density may be selected from the group consisting of virgin tungsten, ferrotungsten, tungsten carbide, tungsten alloys and scrap tungsten. The powdered constituents having a density substantially lower than the predetermined aggregate density may be selected from the group consisting of Fe, Ni, Cu and combinations thereof. The powdered constituents may be agitated using an agitator selected from the group consisting of a drum, disk, dish and pan. Agitating the powdered constituents with a binding agent causes the pellets to agglomerate in generally uniform layers. The predetermined aggregate density may be about 10 to 15.5 g/cm$^3$, and the sintered projectiles may have a diameter in the range of 0.070" to 0.220". Sintering the pellets may cause the pellets to shrink about 10% to 25%. The pellets may form projectiles suitable for use as shots in a shotgun shell. In one embodiment, distinct mixes of powdered components may be agitated in stages to form pellets having layers of different compositions.

In another embodiment, a method of making spherical shots comprises providing powders comprising tungsten and at least one of copper, iron and nickel. The powders are added to a mechanical agitator while directing liquid binder into the mechanical agitator. The agitator is rotated while continuing to add the powders, whereby powders wetted by the liquid binder agglomerate to form densified balled materials. The method may further comprise screening the densified balled materials to eliminate materials outside of a desired diameter range. The powders may form densified balled materials having a diameter in the range of about 0.05" to 0.36". The powders may comprise copper, iron and nickel. The powders may form densified balled materials having a density of about 10 to 16 g/cm$^3$, more preferably of about 10 to 13.5 g/cm$^3$. The method may further comprise sintering the densified balled materials, such as in a first lower temperature stage and at a second higher temperature stage. The mechanical agitator may comprise a rotating drum. The powders may form densified balled materials at a rate of about 0.1 to 1 mm/hour.

In another embodiment, a method of making ammunition projectiles is provided. A first mix of powdered components is provided, and the first mix is agglomerated with a binding agent to form a pellet core having a first composition. A second mix of powdered components is provided, and the second mix is agglomerated with a binding agent to form a layer surrounding said pellet core having a second composition. The pellet core and the layer are sintered to produce the projectiles.

In one embodiment, the layer surrounding the pellet core may be an intermediate layer, and the method may further comprise providing a third mix of powdered components, and agitating the third mix of powdered components with a binding agent to form a surface layer surrounding the intermediate layer having a third composition. The first composition and third composition may be substantially the same. After sintering, the surface layer and the core may be relatively softer than the intermediate layer. After sintering, the surface layer and the core may have a density between about 8 and 10 g/cm$^3$ and the intermediate layer may have a density between about 11 and 18 g/cm$^3$. In another embodiment, the layer surrounding the pellet core is a surface layer. After sintering the surface layer may have a density between about 8 and 10 g/cm$^3$ and the core may have a density between about 11 and 18 g/cm$^3$. The first mix and the second mix may comprise tungsten and at least one of iron, copper and nickel. The sintered projectiles may form shots suitable for use in a shotgun shell. The pellet core and the layer surrounding the pellet core may have different hardnesses.

BRIEF DESCRIPTION OF THE DRAWINGS

FIG. 11I is an x-ray map of the sample of FIG. 11G, illustrating tungsten content;

FIG. 12I is an x-ray map of the sample of FIG. 12G, illustrating tungsten content;

FIG. 13I is an x-ray map of the sample of FIG. 13G, illustrating tungsten content;

DETAILED DESCRIPTION OF THE PREFERRED EMBODIMENTS

Figure 1:
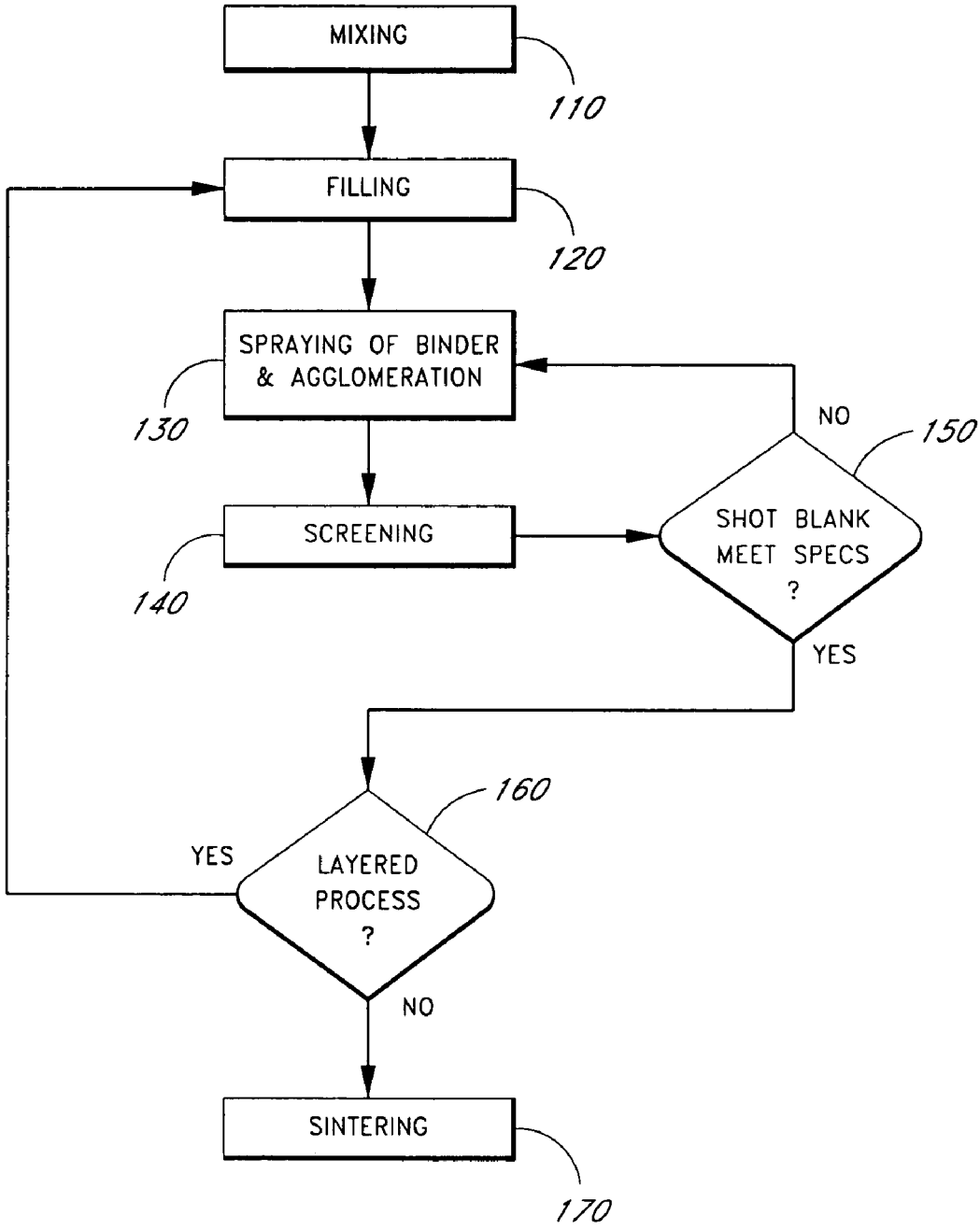
FIG. 1 is a flow chart for forming a shot in accordance with one embodiment of the present invention.

In aerodynamics, parasitic drag is the force caused by moving a solid object through a fluid such as air. Parasitic drag is made up of many components, the most prominent being form drag. The general size and shape of the body is the most important factor in form drag; bodies with a larger apparent cross-section will have a higher drag than thinner bodies. "Clean" designs, or designs that are streamlined and smoothed also contribute to achieving minimum form drag. Form drag follows the drag equation:

$$D=\tfrac{1}{2}(Cd)(\rho)A(V^2)$$

Where

D=drag force

Cd=drag coefficient

ρ=density of fluid

A=reference area

V=velocity of the projectile relative to the fluid

Inarguably, smoother objects can have much lower values of Cd; everything being equal, a precise sphere with a smoother surface will give minimal drag force. More importantly, a group of such high quality spheres will travel in a cohesive way toward a target thus give the best density pattern and maximum delivered energy.

Water fowl loads are regarded as high performance use for which the market often demands high quality shots. The manufacturing process disclosed herein provides high quality nontoxic high density shots that not only have predictable ballistic characteristics during launch, but also have superior loading characteristics for smooth charge during fabrication. This benefits both the manufacturer and general public reloader alike.

In a first embodiment of the invention, a high density, nontoxic shot is provided that is generally consistent in material construction and composition throughout the cross section of the shot. The nontoxic shot is substantially lead-free. As used herein, the term "shot" refers to an ammunition projectile that may be in the form of a pellet, sphere, ball or other small projectile used, for example, to form a charge of a shotgun. Although the preferred embodiments are described with respect to shots, it will be appreciated that embodiments of this invention may be applicable to any suitable type of ammunition projectile, such as bullets and buck shots.

The shot according to this first embodiment preferably comprises tungsten as a first component and preferably copper and/or iron as a second component. In one embodiment, the shot comprises tungsten as the primary component, and may also comprise secondary components comprising copper and/or iron. The term "primary" or "primarily" as used herein indicates that there is more of this component than any other component, although it will be appreciated that in some embodiments, there may be less tungsten than another component. Tungsten may be provided in the form of virgin tungsten, ferrotungsten, tungsten carbide, tungsten alloys and even scrap tungsten. In one embodiment, nickel may also be used as a secondary component. In other embodiments, polymers may also be used as secondary components. Alternatively, compositions may be used with a relatively high amount of copper (e.g., about 19% or more), and substantially no nickel, as nickel can be harmful to small creatures that may be food to fish. Tables 1 and 2 illustrate preferred compositions for a tungsten shot without nickel having different aggregate densities. Percentages as provided herein are in weight percent.

TABLE 1

| Density (g/cm$^3$) | W wt % | Cu wt % | Fe wt % |
|---|---|---|---|
| 13.50 | 70 | 19 | 11 |
| 13.00 | 66 | 19 | 15 |
| 12.50 | 62 | 21 | 17 |
| 12.00 | 59 | 21 | 20 |
| 11.50 | 53 | 24 | 23 |
| 11.00 | 49 | 24 | 27 |
| 10.50 | 43 | 26 | 31 |
| 10.00 | 38 | 26 | 36 |

TABLE 2

| Density (g/cm$^3$) | W wt % | Fe wt % |
|---|---|---|
| 13.50 | 73.40 | 26.60 |
| 13.00 | 70.00 | 30.00 |
| 12.50 | 66.00 | 34.00 |
| 12.00 | 62.00 | 38.00 |
| 11.50 | 58.00 | 42.00 |
| 11.00 | 53.20 | 46.80 |
| 10.50 | 47.60 | 52.40 |
| 10.00 | 41.40 | 58.60 |

Tables 3A, 3B and 3C illustrate alternative compositions for a tungsten shot also containing nickel. These compositions have a relatively low amount of nickel (e.g., about 7% or less), and less copper than in the embodiments above, to minimize any harmful effects of the nickel content.

TABLE 3A

| Density (g/cm$^3$) | W wt % | Ni wt % | Cu wt % | Fe wt % |
|---|---|---|---|---|
| 13.50 | 70 | 7 | 11 | 12 |
| 13.00 | 66 | 7 | 11 | 16 |
| 12.50 | 62 | 7 | 13 | 18 |
| 12.00 | 59 | 7 | 13 | 21 |
| 11.50 | 53 | 7 | 15 | 25 |
| 11.00 | 49 | 7 | 15 | 29 |
| 10.50 | 43 | 7 | 16 | 34 |
| 10.00 | 38 | 7 | 16 | 39 |

TABLE 3B

| Density (g/cm$^3$) | W wt % | Ni wt % | Cu wt % | Fe wt % |
|---|---|---|---|---|
| 13.50 | 69 | 7 | 13 | 11 |
| 13.00 | 64 | 7 | 13 | 16 |
| 12.50 | 59 | 7 | 13 | 21 |
| 12.00 | 59 | 7 | 13 | 21 |
| 11.50 | 57 | 7 | 13 | 23 |
| 11.00 | 54 | 7 | 11 | 28 |
| 10.50 | 51 | 7 | 11 | 31 |
| 10.00 | 48 | 7 | 11 | 34 |

TABLE 3C

| Density (g/cm$^3$) | W wt % | Ni wt % | Cu wt % | Fe wt % |
|---|---|---|---|---|
| 13.50 | 69 | 6 | 13 | 12 |
| 13.00 | 65 | 6 | 13 | 16 |
| 12.50 | 61 | 6 | 14 | 19 |
| 12.00 | 56 | 7 | 15 | 22 |
| 11.50 | 52 | 7 | 15 | 26 |
| 11.00 | 47 | 7 | 15 | 31 |
| 10.50 | 41 | 7 | 16 | 36 |
| 10.00 | 35 | 7 | 17 | 41 |

In certain preferred embodiments, tungsten can be provided in the range of about 30 wt % to about 80 wt %, more preferably about 35 wt % to about 75 wt %, and may be provided in amounts greater than about 40 wt %, about 45% wt %, about 50 wt %, about 55 wt %, about 60 wt %, about 65 wt %, or about 70 wt %, depending on the desired final density of the shot. Copper may be provided in ranges from about 10 wt % to about 30 wt %, more preferably about 10 to 20 wt %, and even more preferably about 11 to 17 wt %, such as when provided in a composition with tungsten, nickel and iron. Nickel may be provided in an amount of about 7 wt % or less. Iron may be provided in an amount of about 10 to 60 wt %, more preferably about 10 to 40 wt %, with higher amounts of iron generally correlating to smaller amounts of tungsten. It will be appreciated that specific combinations of compositions may be selected to optimize not only the density of the material, but also to optimize the hardness of the shot as well as the ability of the materials to agglomerate and form a uniform, layered structure, described further below.

Although the shot examples provided above illustrate a density of between about 10 and 13.5 g/cm$^3$, it will be appreciated that shots in accordance with the preferred embodiments can be made of any desired density, for example, between about 10 and 16 g/cm$^3$, more preferably between about 10 and 15.5 g/cm$^3$, even more preferably between about 10 and 15 g/cm$^3$. In one preferred embodiment, the shot may have a density of less than 13.5 g/cm$^3$, even more preferably about 11 to 12 g/cm$^3$.

Referring in more detail to the drawings, FIG. 1 illustrates one embodiment of the sequence of steps followed in the manufacture of nontoxic high density shots wherein the density can be closely controlled according to the desired ballistics and other characteristics of the projectiles. In step 110, an appropriate mix of raw materials is obtained with the desired composition, such as described above. In the preferred embodiments, raw materials are in the form of powdered constituents obtained from known sources, and may comprise tungsten powder and iron, copper and/or nickel powder. The powders may be mixed in a suitable ball mill as is known to one of skill in the art.

Figure 2:
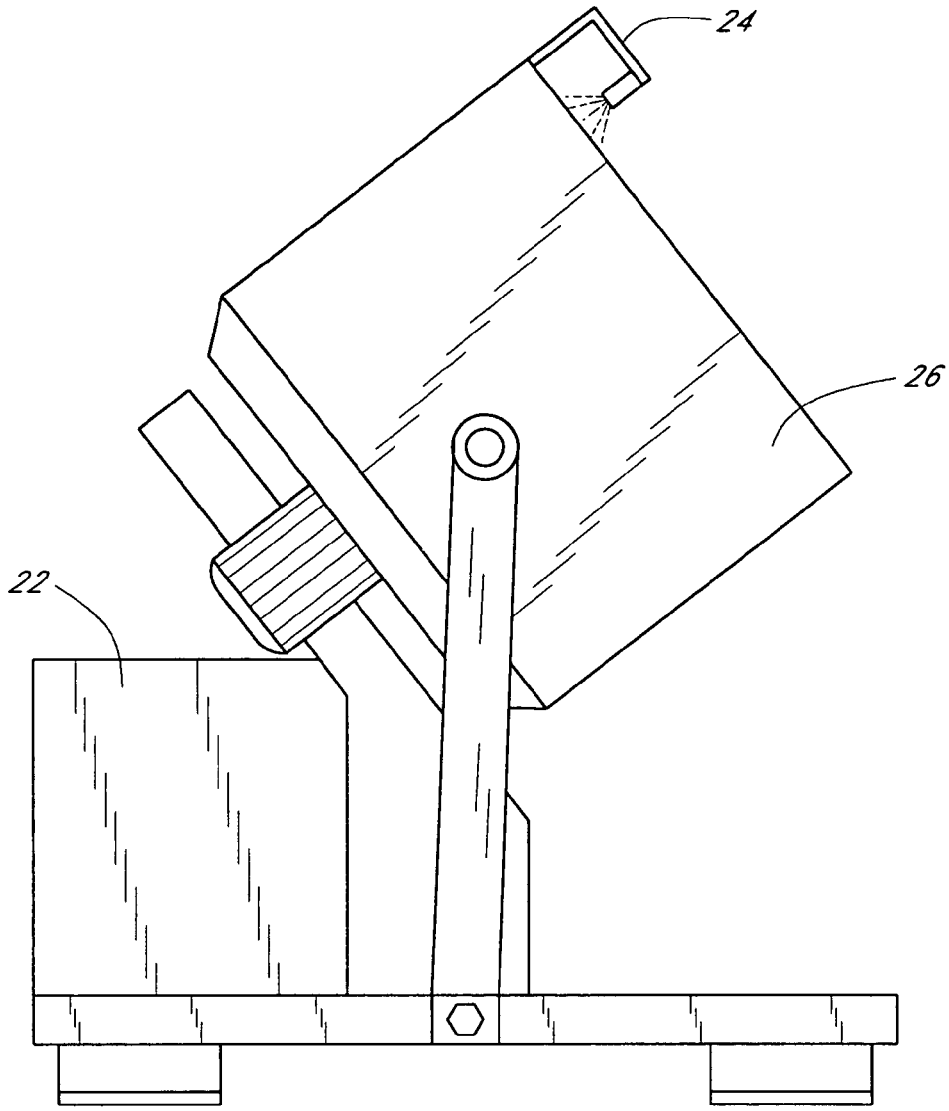
FIG. 2 is a schematic view of a mechanical agitator for forming a shot in accordance with one embodiment of the present invention.
Figure 3:
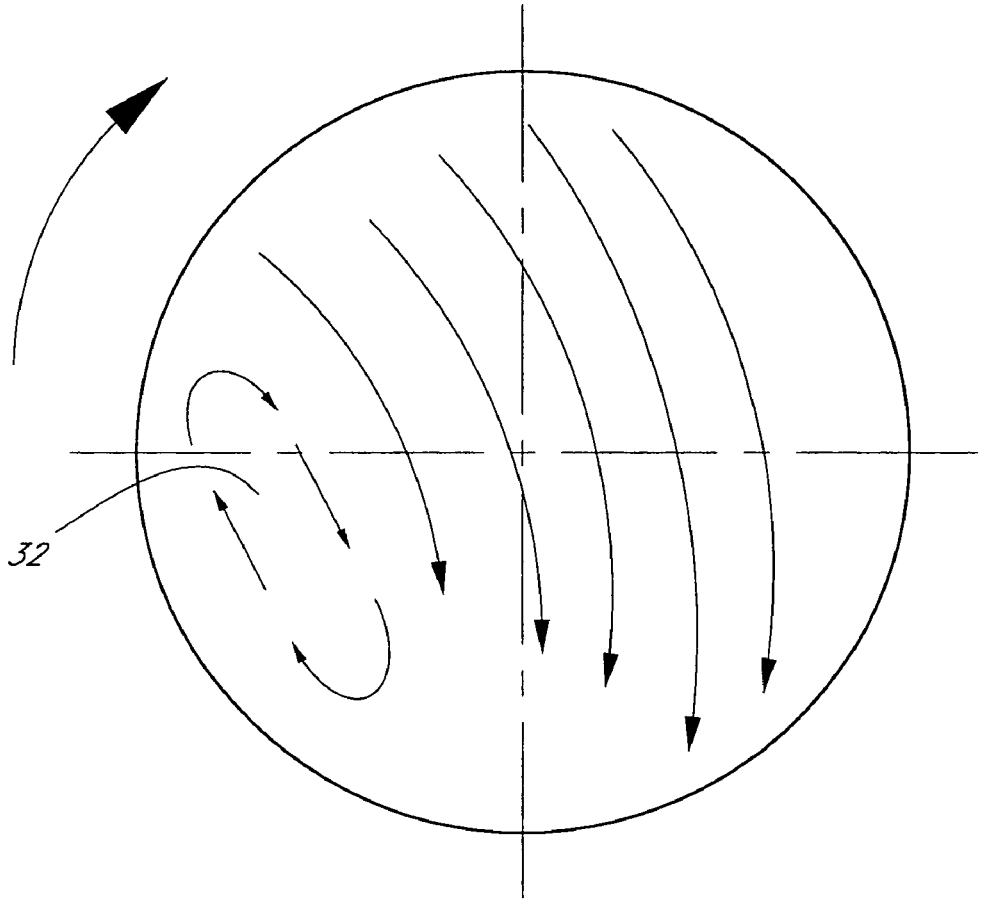
FIG. 3 is a top view of the agitator of FIG. 2.
Figure 4:
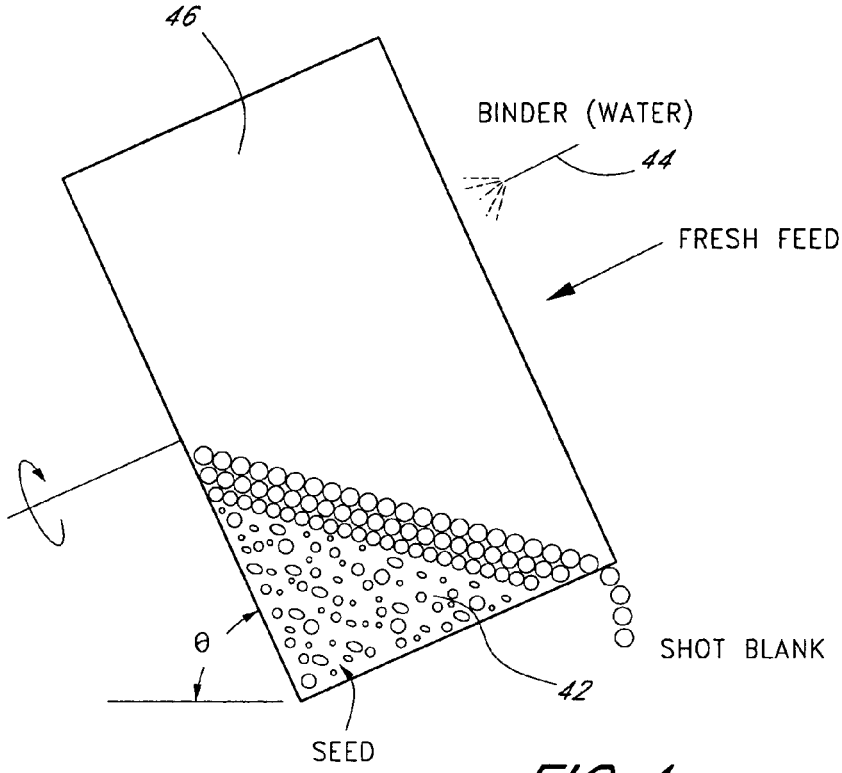
FIG. 4 is schematic view of one preferred form of a tumbling or agitation process used in conjunction with that of FIG. 3 in forming shots.

The mixed powders are then filled into an appropriate processing apparatus (step 120). One preferred form of the apparatus is illustrated in FIGS. 2 through 4, which illustrates the use of a mechanical agitation or tumbling process to agglomerate the powders in a rotating drum. In one embodiment, an agitator 22 that is used is an inclined drum shaped mechanical agitator or agglomerator. Other suitable apparatuses may include other drum or disk, dish or pan agglomerators. Further details of suitable agglomerators and associated processes are described in Wolfgang Pietsch, *Agglomeration Processes: Phenomena, Technologies, Equipment* (Wiley-VCH Verlag GmbH, Weinheim, 2002), the entirety of which is hereby incorporated by reference.

The agitator 22 can be equipped with air atomized spray nozzles 24 directing binder flow 44 (step 130) to a powder section 46 on the rotating drum 26. As binder flows into the drum, FIG. 4 shows the wetted powders 42 on rotation agglomerate and begin to form densified balled material or spheres. These small spheres tend to segregate toward the edge of the drum 26, changing their flow pattern 32 in the drum as shown in FIG. 3. Constant monitoring of the process is preferred, with control on the particle size growth and distribution determined by a spraying rate, incoming feed rate, drum rpm and angle of inclination. Preferably, a very low spraying rate is used such that the spheres form and grow very slowly, allowing the sphere layers to grow uniformly. This slow growth also ensures a denser product having fewer or virtually no air pockets.

In one embodiment, the agitator 22 has a size of 22 inches in diameter, and can be operated under the following parameters.

TABLE 4

| | |
|---|---|
| Spraying Rate | Varying |
| Incoming Feed Rate | Varying |
| Drum RPM | 15 to 40 |
| Angle of Inclination | 45 degrees |

The agitator preferably uses a liquid binder, more preferably only water. In other embodiments, the binder may be an organic or inorganic binders. Examples of suitable organic binders include, but are not limited to CMC (carbo-methylcellulose), alcohols, paraffin, polyvinyl alcohol (PVA), starches, and gums. Examples of inorganic binders include, but are not limited to, alkali silicates, alum, gypsum, lime, and water.

Figure 5:
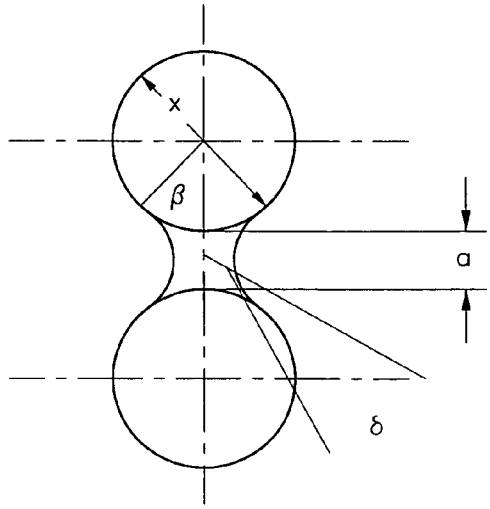
FIG. 5 is a schematic view of a liquid bridge between two moisturized sphere particles for forming a shot in accordance with one embodiment of the present invention.

The spheres preferably grow in layers due to particle adhesion, whereby forces between spheres are caused by liquid bridges. Capillary pressure and tensile strength of moist particles are associated with each other, and are influenced to a great extent by the amount of liquid that is present in the pore volume of the agglomerate. With increasing liquid saturation, more and more pores are filled and the liquid bridge and the saturated pores models coexist. The adhesion force of a liquid bridge is proportional to the surface tension $\alpha$, the particle diameter x, and a function of the liquid bridge angle $\beta$, the angle of contact $\delta$, and the dimensionless quotient a/x, which represents distance at the coordination point. As shown in FIG. 5 the effective adhesion force of a liquid bridge is defined as:

$$A_{iL}=\alpha x f(\beta,\delta,a/x)$$

Further details are described in Wolfgang Pietsch, *Agglomeration Processes: Phenomena, Technologies, Equipment* (Wiley-VCH Verlag GmbH, Weinheim, 2002), page 58, incorporated by reference above.

If desired, the spraying of the binder into the drum may optionally be turned on and off as needed to ensure uniform agglomeration. Optionally, choppers may also be used to avoid unwanted agglomeration or the formation of oversized conglomerates. For example, a high speed chopper, knife head, accelerator, intensifier, turbine, mill or other suitable tool (all referred to herein generically as a "chopper") is used to destroy undesired agglomerates which hamper mixing. Choppers can be applied at any suitable point in the process, and may operate at high speeds, e.g., in excess of 500 rpm, 1000 rpm or 1800 rpm. Choppers also assist in distributing binder liquid more uniformly.

After the spheres have grown to an appropriate desired size, precise control over the size of the spheres may be maintained by using a screening process in step 140. In one embodiment, screens may be used through which the spheres may be passed. A first screen may be used which has a minimum pore diameter, such that any spheres that pass through the screen will be rejected. These rejected spheres can be recycled into the agitator until further growth makes them of a potentially viable size. A second screen may be used which has a maximum pore diameter, such that only spheres that pass through the screen may be accepted for sintering. Spheres that exceed the pore size of the screen can be crushed and then recycled as powder in the agitator.

With the spheres that have passed the screening process, a visual inspection may be used to ensure whether the shots meet desired specifications (step 150). In one method, a lot of 100 g of shots is taken, and the number of pieces of shots is counted. If the number falls within a desired range, this reflects that the desired average density of the shots has been achieved. In another method, shot diameters can be measured using a micrometer or Vernier calipers along multiple axes of a shot to determine whether the shot has substantially uniform sphericity, as described below. Shots that do not meet specifications can be recycled such as by crushing back into the process.

Spheres that have passed the screening process and a visual inspection, if performed, may proceed to step 160. At step 160, a determination is made whether a multi-layer shot of differing compositions between distinct layers is to be formed. The formation of multi-layer shots is described in further detail below. For shots formed according to the first embodiment, the process continues to step 170.

The spheres are then sintered, for example in a first stage at about 650° C. for about 1.8 to 2 hours, and then at a second stage at about 1380° C. for about 1.8 to 2 hours for a Ni containing mix with Cu, and about 1450° C. for a mix without nickel. Other suitable sintering conditions may also be used. From the unsintered, green shot to the sintered shot, the spheres preferably shrink between about 10% to 25%, more preferably about 15% to 20% in diameter. Table 5 illustrates examples of shrink ratios to form shots of certain size ranges:

TABLE 5

| Size Range | Shrink Ratio (Green Shot: Sintered Shot) |
|---|---|
| 0.100" to 0.120" | 1.16:1.00 |
| 0.130" to 0.140" | 1.17:1.00 |
| 0.150" to 0.180" | 1.18:1.00 |
| 0.190" to 0.220" | 1.20:1.00 |

The agitation process desirably provides precise control of a final, sintered product by operating the agitator in a continuous, prolonged and controlled manner. Moreover, tight control over the ratio of particles in the sintering mix further contributes to precise control in the final sintered product. No grinding or polishing is needed to achieve tolerance prescribed.

The precision and control over the processing of the shot allows for bulk quantity production in a very wide range of sizes, for example, from 0.070" to 0.220" in diameter, selected and processed to have very high tolerance. Shots can be made into any desired diameter suitable for use in a shotgun shell, for example, between about 0.05" to about 0.36", and more particularly 0.100", 0.110", 0.120", 0.130", 0.150", and 0.180". Tolerance may be measured by the ball diameter variation of a sphere, e.g., by comparing the largest diameter of a sphere to the smallest diameter of the same sphere, and can be ensured using the screening process described above. A lot diameter variation can also be measured, comparing the largest diameter of any sphere to the smallest diameter of any sphere. In one embodiment, the lot diameter variation is preferably about 0.01" or less, more preferably about 0.008" (about 0.20 mm) or less, more preferably about 0.006" (about 0.15 mm) or less, even more preferably about 0.005" or less. The ball diameter variation is usually about ½ or larger of the lot diameter variation, more preferably about 50 to 85% of the lot diameter variation (i.e., about 0.004" to 0.0068" or less, more preferably about 0.003" to 0.0051" or less, even more preferably about 0.0025" to 0.00425" or less). Thus, no pressing, compacting or casting is required, making for exceptional efficiency in making smaller shots that are very uniform in size.

Shots formed according to the first embodiment preferably have a desired hardness, for example about Vickers hardness HV 230 or less. Vickers hardness may be measured using a suitable Vickers hardness machine, for example using forces of 1, 2, 5, 10, 30, 50 and 100 kgf. In one particular embodiment, shots formed according to the method described above and tested using 30 kgf provides a Vickers hardness of between about HV 105 and HV 132. An alternative measurement of hardness may use a Rockwell hardness test.

In one embodiment, the shot preferably has a hardness of about 86 HR15T or less.

Figure 6A:
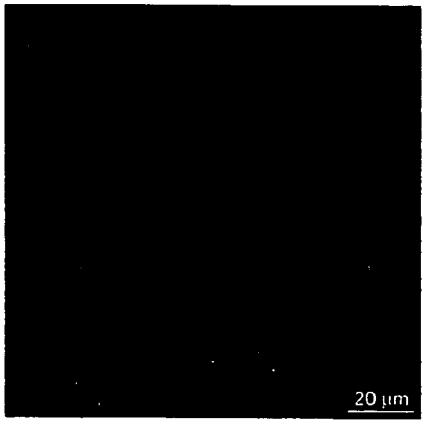
FIG. 6A is a scanning electron micrograph at 1000× magnification of a section of a shot formed according to a first embodiment of the present invention.
Figure 6B:
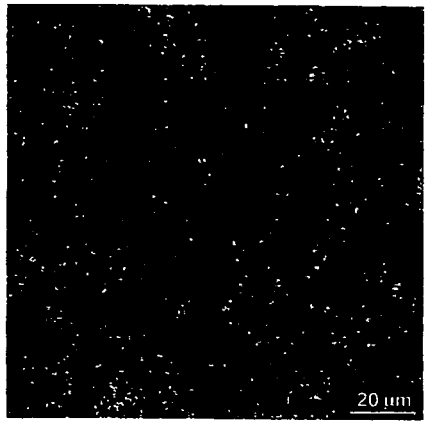
FIG. 6B is an x-ray map of the section of shot of FIG. 6A, illustrating tungsten content.
Figure 6C:
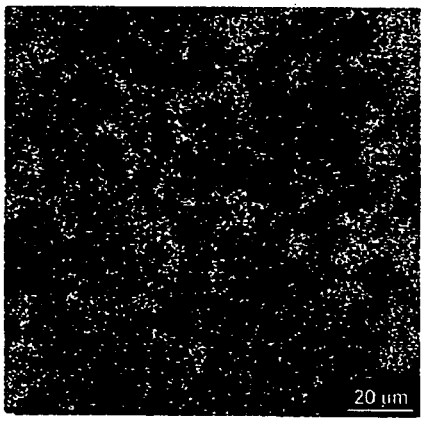
FIG. 6C is an x-ray map of the section of shot of FIG. 6A, illustrating iron content.
Figure 6D:
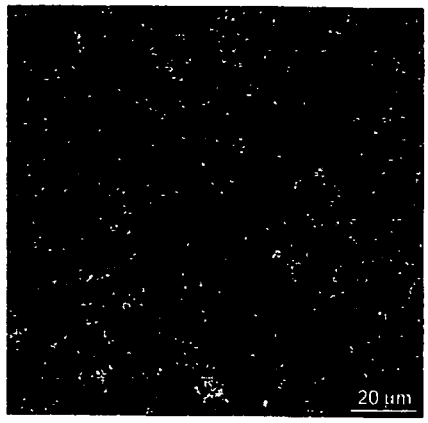
FIG. 6D is an x-ray map of the section of shot of FIG. 6A, illustrating copper content.
Figure 6E:
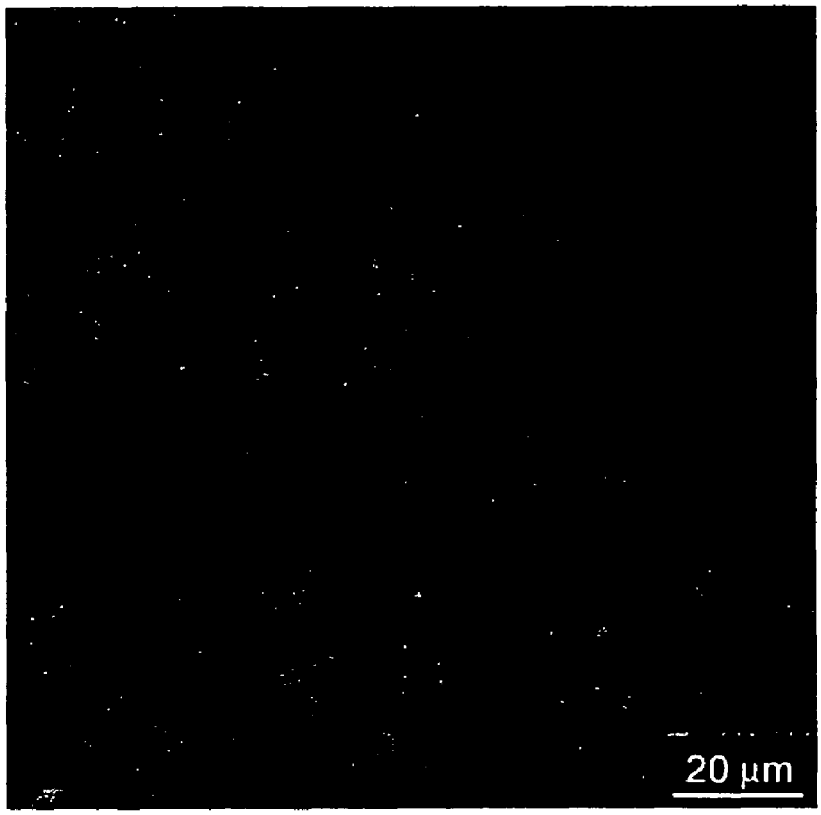
FIG. 6E is another scanning electron micrograph at 1000× magnification of a section of a shot formed according to the first embodiment of the present invention.
Figure 6F:
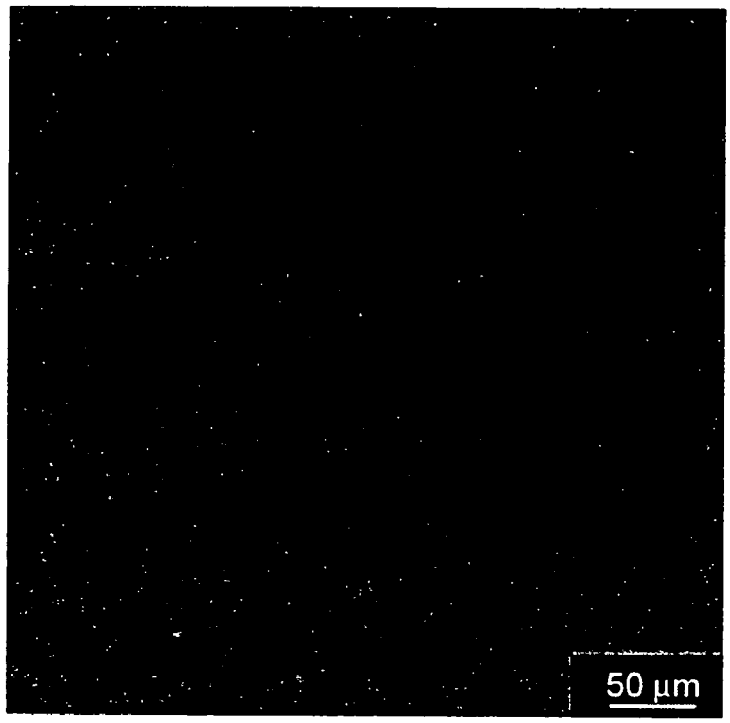
FIG. 6F is a scanning electron micrograph at 300× magnification of the shot of FIG. 6E.

FIG. 6A is a scanning electron micrograph at 1000× magnification of a shot formed according to the first embodiment described above. This shot has a density of about 11 g/cm$^3$, with a composition of about 48 wt % W, about 7 wt % Ni, about 15 wt % Cu and about 30 wt % Fe. FIG. 6E shows another scanning electron micrograph at 1000× magnification of this shot, and FIG. 6F shows a scanning electron micrograph of the shot at 300× magnification. As can be seen, the shot has generally circular tungsten-rich grains of substantially the same size (e.g., about 10 microns or less in diameter) that are generally uniformly distributed. This uniform distribution is further illustrated in FIGS. 6B-6D, which illustrate x-ray maps of the shot for tungsten, iron and copper, respectively. In each of these x-ray maps, the lighter portions represent tungsten, iron or copper content, respectively. It can be seen from these maps that the distribution of these components is generally uniform throughout the shot, which can be attributed to the layered growth accomplished using the agglomeration process described above.

In a second embodiment of the invention, in the flow chart of FIG. 1, at step 160, a layered process is used. In such an embodiment, after spheres of a first desired diameter are formed, the process returns to step 110, where a second composition of powders is mixed. It will be appreciated that the second composition of powders may have been pre-prepared. This second composition of powders is preferably selected to produce either a relatively harder or softer layer of material, preferably with a higher or lower density, as desired by the final shot. Preferably, at step 120, the apparatus 22 is filled and mixed with a different composition of raw materials to provide a layer having a different composition surrounding the first layer or core formed above. Agglomeration occurs as above to a desired size, and the resulting spheres can be screened and inspected as above. If additional layers are desired (e.g., three or more layers), the process at 160 returns again to steps 110 and 120 for mixing and filling additional powder compositions into the apparatus for formation of the multiple layers over preceding layers. Once the shots are formed having the desired number of layers, with the desired composition of each layer, the desired sphericity and the desired aggregate density, the shots can be sintered as described above.

In one embodiment, a high density nontoxic shot is provided that has a generally soft core, a rugged intermediate layer, and a soft surface layer. Each of the layers is preferably spherical in shape and have the same center. The specific weight of each layer is preferably different from the next layer, selected to allow a wide range of aggregate density, no matter the production method used. In another embodiment, a two layer shot may be formed having a rugged core, and a soft surface layer. Shots with other numbers of distinct layers may also be provided.

Figure 7:
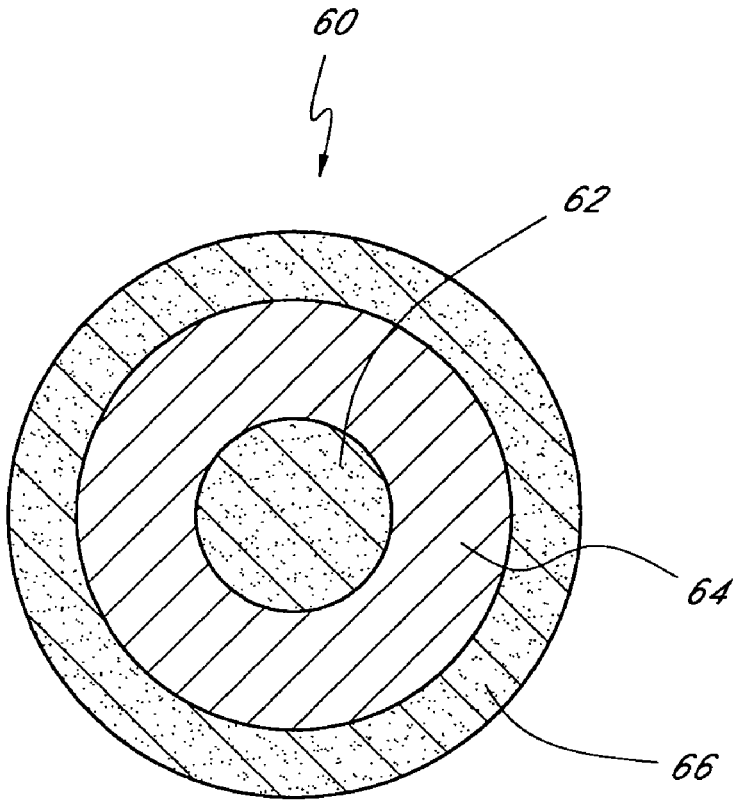
FIG. 7 is a schematic cross section of a shot in accordance with another embodiment of the invention.

FIG. 7 illustrates a cross section of one embodiment of a three layer shot. The shot 60 includes a core 62, an intermediate layer 64, and a surface layer 66. Each of the core 62, the intermediate layer 64 and the surface layer 66 preferably have a spherical outer surface, and preferably have the same center. The core 62 and surface layer 66 are preferably softer and less dense relative to the intermediate layer, which is relatively harder and denser.

The composition of each of the layers may be selected to produce the desired density and hardness. Each of the layers having different composition may preferably be formed from substantially lead-free compositions comprising tungsten as a first component, and iron, copper and/or nickel as additional component(s). For example, compositions taken from Tables 1-3C and used for shots made according the first embodiment above may be used for the intermediate layer. For the core and surface layers, less or no tungsten may be used. For example, in one embodiment, about 10% W or less may be used, with greater than about 60% Fe, and between about 4 and 15% Ni and about 10% and 20% Cu. In one preferred embodiment, the surface layer may have about 10% W, about 63% Fe, and about 27% Cu and Ni (e.g., about 16% Cu and about 11% Ni), forming a layer with a density of about 9.3 g/cm$^3$.

Table 6 illustrates one example of the aggregate density of a three-layered sphere.

TABLE 6

| Density (g/cm$^3$) | W wt % | Ni wt % | Cu wt % | Fe wt % |
|---|---|---|---|---|
| 13.50 | 71 | 5 | 9 | 15 |
| 13.00 | 68 | 5 | 9 | 18 |
| 12.50 | 63 | 6 | 12 | 19 |
| 12.00 | 59 | 6 | 14 | 21 |
| 11.50 | 54 | 7 | 14 | 25 |
| 11.00 | 49.3 | 7 | 15 | 28.7 |
| 10.50 | 43 | 7 | 16 | 34 |
| 10.00 | 40 | 7 | 16 | 37 |

In other embodiments, the aggregate density of the three-layer shot may correspond to the values provided in Tables 1, 2, 3A, 3B or 3C above.

Tables 7A and 7B illustrate compositions that may be used for the soft inner core and soft surface layer of a three layer shot. For example, the composition in Table 7A may be used for the core and surface layer of a relatively smaller shot e.g., of 0.120" in diameter, and the composition in Table 7B may be used for the core and surface layer of a relatively larger shot, e.g., of 0.22" in diameter.

TABLE 7A

| Density (g/cm$^3$) | W wt % | Ni wt % | Cu wt % | Fe wt % |
|---|---|---|---|---|
| 13.50 | 10 | 10.4 | 16.6 | 63 |
| 13.00 | 10 | 10.1 | 16.9 | 63 |
| 12.50 | 10 | 9.5 | 17.5 | 63 |
| 12.00 | 10 | 9.0 | 18 | 63 |
| 11.50 | 10 | 10.0 | 17 | 63 |
| 11.00 | 10 | 9.5 | 17.5 | 63 |
| 10.50 | 10 | 9.0 | 18 | 63 |
| 10.00 | 10 | 8.2 | 18.8 | 63 |

TABLE 7B

| Density (g/cm$^3$) | W wt % | Ni wt % | Cu wt % | Fe wt % |
|---|---|---|---|---|
| 13.50 | 10 | 10.1 | 16.9 | 63 |
| 13.00 | 10 | 9.5 | 17.5 | 63 |
| 12.50 | 10 | 9 | 18 | 63 |
| 12.00 | 10 | 9.9 | 17.1 | 63 |
| 11.50 | 10 | 9.5 | 17.5 | 63 |
| 11.00 | 10 | 9 | 18 | 63 |
| 10.50 | 10 | 8.6 | 18.4 | 63 |
| 10.00 | 10 | 8.2 | 18.8 | 63 |

Tables 8A and 8B illustrate compositions that may be used for the harder intermediate layer of a three layer shot. For example, the composition in Table 8A may be used for a relatively smaller shot e.g., of 0.120" in diameter, and the composition in Table 9B may be used for a relatively larger shot, e.g., of 0.22" in diameter.

TABLE 8A

| Density (g/cm$^3$) | W wt % | Ni wt % | Cu wt % | Fe wt % |
|---|---|---|---|---|
| 13.50 | 87 | 5 | 8 | 0 |
| 13.00 | 82 | 6 | 10 | 2 |
| 12.50 | 77 | 6 | 11 | 6 |
| 12.00 | 73 | 6 | 12 | 9 |
| 11.50 | 67 | 7 | 12 | 14 |
| 11.00 | 61 | 7 | 13 | 19 |
| 10.50 | 56 | 7 | 14 | 23 |
| 10.00 | 46 | 7 | 16 | 31 |

TABLE 8B

| Density (g/cm$^3$) | W wt % | Ni wt % | Cu wt % | Fe wt % |
|---|---|---|---|---|
| 13.50 | 81 | 6 | 10 | 3 |
| 13.00 | 77 | 6 | 11 | 6 |
| 12.50 | 72 | 6 | 12 | 10 |
| 12.00 | 67 | 7 | 12 | 14 |
| 11.50 | 62 | 7 | 13 | 18 |
| 11.00 | 56 | 7 | 14 | 23 |
| 10.50 | 49 | 7 | 15 | 29 |
| 10.00 | 42 | 7 | 16 | 35 |

It will be appreciated that the diameter of the core 62, the thickness of the intermediate layer 64, and the thickness of the surface layer 66 may be adjusted to provide the desired balance of density and hardness for the aggregate shot 60. In certain embodiments, the diameter of the core 62 may range from about 1.4 mm to about 2.4 mm, the thickness of the intermediate layer may range from about 0.5 mm to about 1.6 mm, and the thickness of the surface layer may be about 0.2 mm or less. In one embodiment, the surface layer 66 may be about 0.1 mm thick for shots having a diameter from 0.070" to 0.100", about 0.15 mm for shots having a diameter from 0.100" to 0.180", and about 0.20 mm for shots having a diameter of 0.180" or greater. For example, for a 0.130" diameter shot, the core may have a diameter of about 1.6 mm, the intermediate layer may have a thickness of about 0.65 mm, and the surface layer may have a thickness of about 0.2 mm. Generally, taking 0.130" as an example, the core radius may be about 40 to 60%, more preferably about 50% of the radius of the aggregate shot, the intermediate layer thickness may be about 30 to 50%, more preferably about 40% of the radius of the aggregate shot, and the surface layer thickness may be about 5 to 15%, more preferably about 12% of the radius of the aggregate shot. As with the first embodiment, shots having a diameter in the range of 0.070" to 0.220" in diameter, or any diameter suitable for use in a shotgun shell, may be made.

As in the first embodiment described above, a mechanical agitation or tumbling process can be used to achieve high tolerance control over the chemistry and ratio in the powder mix. Continuous, prolonged, and controlled agitation using a drum agitator, for example, also allows the ability to prescribe a transitioned composition so to achieve transition of hardness at different layer of the shot, from core to surface. Multiple powder mixes are provided with selected compositions to add to the agitator in stages to form each desired layer. In one embodiment, drums can be changed in the agitator from the core mix to the intermediate mix, and then drum can be changed back to the core mix to form the surface layer. Thus, in this example, the core and the surface layer have the same composition. Preferably, after each of the core 62, intermediate layer 64, and surface layer 66 are formed, screening such as described above takes place to assure uniformity and sphericity of product. Recycling of metal powder is built into the production process so there is no waste and very little scrap material. The shot can be sintered such as described above.

As with the first embodiment described above, a slow growth process is used to ensure sphericity of the formed spheres. In one embodiment, the core is grown in the agitator over about 2 to 3 hours, the intermediate layer is grown in the agitator for about 3 to 5 hours, and the surface layer is grown in the agitator over about 1 hour. Overall, the growth rate of the spheres may be in the range of about 0.1 to 1 mm/hour, more preferably about 0.1 to 0.5 mm/hour, and even more preferably about 0.1 to 0.3 mm/hour.

In one embodiment, the core 62 has a density of between about 8 and 10 g/cm$^3$, the intermediate layer 64 has a density of between about 11 and 18 g/cm$^3$, more preferably between about 11 and 13.5 g/cm$^3$, and the surface layer 66 has a density of between about 8 and 10 g/cm$^3$. The aggregate density of the shot 60 can be adjusted, depending on the thickness of each layer, to produce densities in the range of about 9 to 16 g/cm$^3$, more preferably between about 9.4 to 15 g/cm$^3$, even more preferably between about 10 and 13 g/cm$^3$, and even more preferably between about 11 and 12 g/cm$^3$.

It will be appreciated that for a two layer shot, the rugged core may have a density between about 11 and 18 g/cm$^3$, and the surface layer may have a density between about 8 and 10 g/cm$^3$. The core of the two layer shot may have compositions such as provided above for the intermediate layer of the three layer shot, and the surface layer of the two layer shot may have compositions such as provided above for the surface layer of the three layer shot. In one embodiment, the core of a two layer shot may have the compositions provided in Table 9A and 9B below. For example, the compositions in Table 9A may be used for the core of a smaller shot, e.g., a 0.07" diameter shot, and the compositions in Table 9B may be used for the core of a larger shot, e.g., a 0.22" diameter shot. The compositions in Tables 10A and 10B may be used for the surface layer of the two layer shot; for example, the compositions in Table 10A may be used for a smaller shot, e.g., a 0.07" diameter shot, and the compositions in Table 10B may be used for a larger shot, e.g., a 0.22" diameter shot. The core and surface layer of a two-layer shot may have thicknesses such as described above. The aggregate density of the two layer shot may correspond to the values provided in Tables 1, 2, 3A, 3B or 3C above.

TABLE 9A

| Density (g/cm$^3$) | W wt % | Ni wt % | Cu wt % | Fe wt % |
|---|---|---|---|---|
| 13.50 | 82 | 6 | 10 | 2 |
| 13.00 | 78 | 6 | 10 | 6 |
| 12.50 | 74 | 6 | 10 | 10 |
| 12.00 | 70 | 6 | 12 | 12 |
| 11.50 | 64 | 6 | 12 | 18 |
| 11.00 | 59 | 7 | 14 | 20 |
| 10.50 | 50 | 7 | 15 | 28 |
| 10.00 | 46 | 7 | 15 | 32 |

TABLE 9B

| Density (g/cm$^3$) | W wt % | Ni wt % | Cu wt % | Fe wt % |
|---|---|---|---|---|
| 13.50 | 77 | 6 | 11 | 6 |
| 13.00 | 73 | 6 | 12 | 9 |
| 12.50 | 69 | 6 | 12 | 13 |
| 12.00 | 64 | 6 | 12 | 18 |
| 11.50 | 59 | 7 | 14 | 20 |
| 11.00 | 53 | 7 | 14 | 26 |
| 10.50 | 47 | 7 | 15 | 31 |
| 10.00 | 40 | 7 | 17 | 36 |

TABLE 10A

| Density (g/cm$^3$) | W wt % | Ni wt % | Cu wt % | Fe wt % |
|---|---|---|---|---|
| 13.50 | 10 | 10 | 17 | 63 |
| 13.00 | 10 | 10 | 17 | 63 |
| 12.50 | 10 | 10 | 17 | 63 |
| 12.00 | 10 | 9 | 18 | 63 |
| 11.50 | 10 | 9 | 18 | 63 |
| 11.00 | 10 | 9 | 18 | 63 |
| 10.50 | 10 | 8.6 | 18.4 | 63 |
| 10.00 | 10 | 8.6 | 18.4 | 63 |

TABLE 10B

| Density (g/cm$^3$) | W wt % | Ni wt % | Cu wt % | Fe wt % |
|---|---|---|---|---|
| 13.50 | 10 | 9.5 | 17.5 | 63 |
| 13.00 | 10 | 9 | 18 | 63 |
| 12.50 | 10 | 9 | 18 | 63 |
| 12.00 | 10 | 9 | 18 | 63 |
| 11.50 | 10 | 9 | 18 | 63 |
| 11.00 | 10 | 9 | 18 | 63 |
| 10.50 | 10 | 8.6 | 18.4 | 63 |
| 10.00 | 10 | 7.9 | 19.1 | 63 |

In the three layer shot, the core 62 and surface 66 may have a hardness of about HV 200 or lower, more preferably about HV 110 or lower, even more preferably about HV 100 or lower. In one embodiment, the surface hardness is between about HV 105 and HV 151, and the core hardness is between about HV 105 and HV 120. The hardness of the intermediate layer 64 may be between about HV 200 and HV 270, more preferably between about HV 200 and HV 220. In a two layer shot, in one embodiment, the surface layer hardness may preferably be about HV 105 or less, and the core hardness may preferably be between about HV 105 and HV 196.

An alternative measurement of hardness may use a Rockwell hardness test. In one embodiment, the surface layer of a two layer or three layer shot is preferably about 80 HR15T or less, more preferably about 69 HR15T or lower. The relatively hard layer (e.g., the core of a two layer shot or the intermediate layer of a three-layer shot) will have a higher hardness value, but preferably will not be too high, and in one embodiment, will have a value of about 86 HR15T or less.

After the shot is formed into a sphere and sintered, tin, copper or zinc can be plated or hot dipped onto the outer surface of the shot. This layer helps to make the shot softer and protect it from oxidation.

Advantageously, the soft core and soft surface layer of the shot of FIG. 7 makes the shot not prong to ricochet and easier on the gun barrel. The harder, denser intermediate layer keeps the shot rugged and in its spherical form in set back (firing), and in flight, until it hits the target. Upon impact with the target, because of the soft core, and somewhat because of the soft shell, this product will deform, thereby transferring the momentum (energy) onto the target.

The softness or hardness of the layers or compositions as measured herein are indicative of the ability of the shot to deform upon impact. Other suitable measurements made also be used, such as by measuring the relative ductility of the material or layer, such that a more ductile material will plastically deform substantially before fracture. The multiple layer shots as described above are manufactured to provide desired deformation of the shot upon impact with a target. For example, in a two layer or three layer shot, the softer outer layer has relatively higher ductility than the core or intermediate layer, allowing the material to deform and spread outwardly upon impact. This enables a greater transfer of energy to the intended target, with increased surface area upon contact. With the three layer shot in particular, where the inner core and the surface layer are both made of a relatively softer, more ductile material, the shot upon impact will desirably flatten to impart greater energy to the target.

It will be appreciated that the methods described above can be modified to form shots of various compositions. For example, a shot can be made with a relatively soft core and a relatively hard surface. Alternatively, a shot can be made with a relatively hard core, a relatively soft intermediate portion and a relatively hard surface.

Soft and hard powder mixes may be selected having desired compositions to produce layers of desired hardness and/or density. In one embodiment, hard powder mixes comprise a significant amount of tungsten, preferably about 60 wt % or more, about 65 wt % or more, or about 70 wt % or more. These hard powder mixes may have densities greater than about 12 g/cm$^3$, more preferably greater than about 13 g/cm$^3$, even more preferably greater than about 14 g/cm$^3$. Softer powder mixes comprise less tungsten, preferably about 30 wt % or less, more preferably about 20 wt % or less, even more preferably about 10 wt % or less. These softer powder mixes may have densities less than about 10 g/cm$^3$, more preferably less than about 9 g/cm$^3$, even more preferably less than about 8 g/cm$^3$.

Figure 8A:
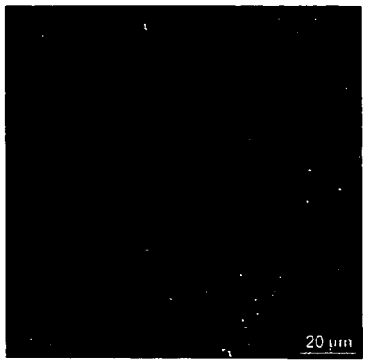
FIG. 8A is a scanning electron micrograph at 1000× magnification of a core section of a two-layer shot formed according to one embodiment of the present invention.
Figure 8B:
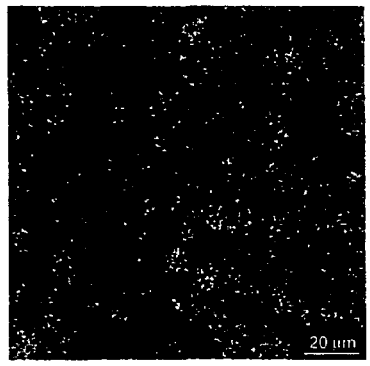
FIG. 8B is an x-ray map of the section of shot of FIG. 8A, illustrating tungsten content.
Figure 8C:
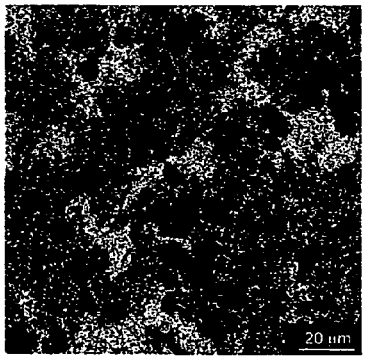
FIG. 8C is an x-ray map of the section of shot of FIG. 8A, illustrating iron content.
Figure 8D:
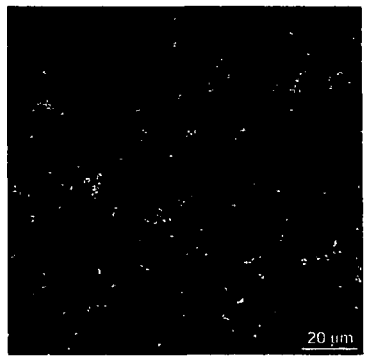
FIG. 8D is an x-ray map of the section of shot of FIG. 8A, illustrating copper content.
Figure 8E:
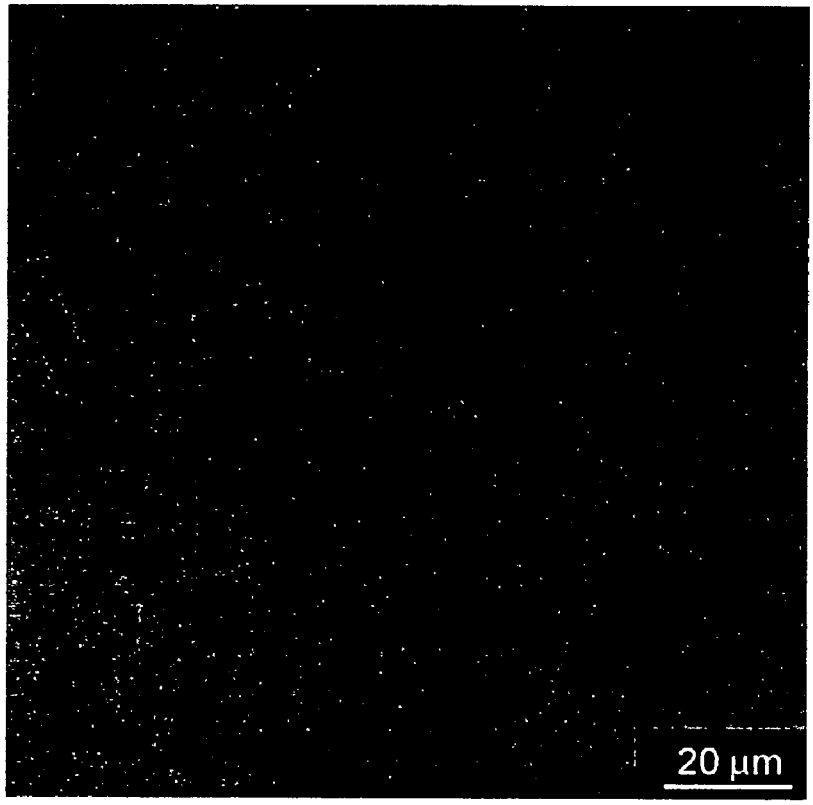
FIG. 8E is another scanning electron micrograph at 1000× magnification of a core section of a two-layer shot formed according to one embodiment of the present invention.
Figure 8F:
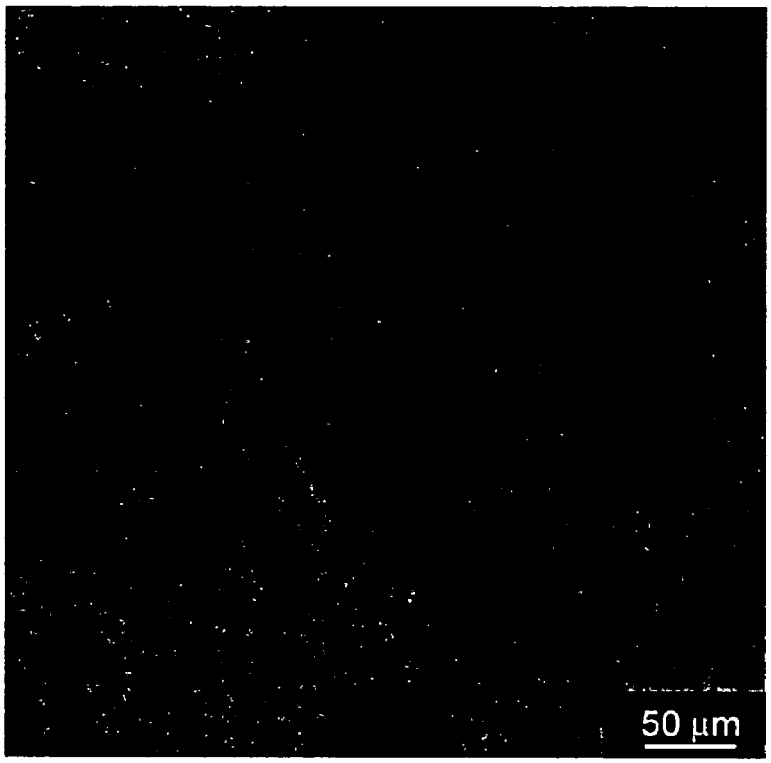
FIG. 8F is a scanning electron micrograph at 300× magnification of the core section of the two-layer shot of FIG. 8E.

FIG. 8A is a scanning electron micrograph at 1000× magnification of a core section of a two-layer shot formed according to the second embodiment of the present invention, having a relatively hard core and a relative soft surface. This shot has an aggregate density of about 11 g/cm$^3$, with a core density of about 13.76 g/cm$^3$ and a surface layer density of about 8.64 g/cm$^3$. The core composition comprises about 69 wt % W, about 7 wt % Ni, about 10 wt % Cu and about 14 wt % Fe. The surface layer composition comprises about 10 wt % W, about 7 wt % Ni, about 20 wt % Cu and about 63 wt % Fe. FIGS. 8B-8D are x-ray maps illustrating tungsten, iron and copper content in the core, respectively, such as described above. FIGS. 8E and 8F are additional scanning electron micrographs at 1000× and 300× magnification, respectively, of the core of the two-layer shot. Like the single composition shot of FIG. 6A above, the core of the two-layer shot has generally circular tungsten-rich grains of substantially the same size (about 10 microns or less), and the grains are generally uniformly distributed.

Figure 9A:
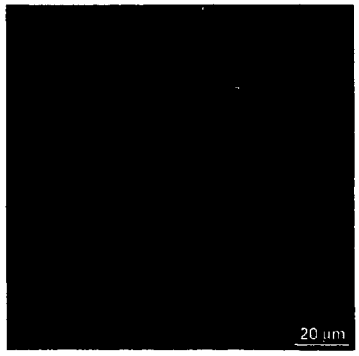
FIG. 9A is a scanning electron micrograph at 1000× magnification of an intermediate layer of a three-layer shot formed according to one embodiment of the present invention.
Figure 9B:
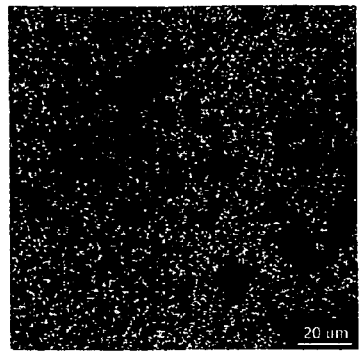
FIG. 9B is an x-ray map of the intermediate layer of shot of FIG. 9A, illustrating tungsten content.
Figure 9C:
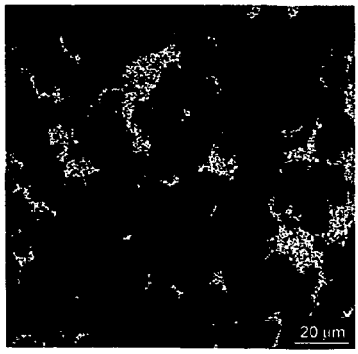
FIG. 9C is an x-ray map of the intermediate layer of shot of FIG. 9A, illustrating iron content.
Figure 9D:
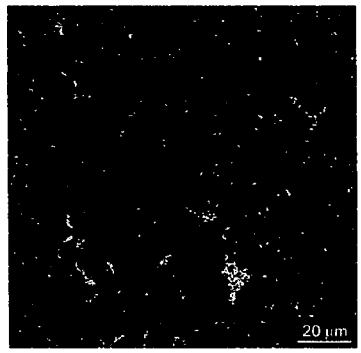
FIG. 9D is an x-ray map of the intermediate layer of shot of FIG. 9A, illustrating copper content.
Figure 9E:
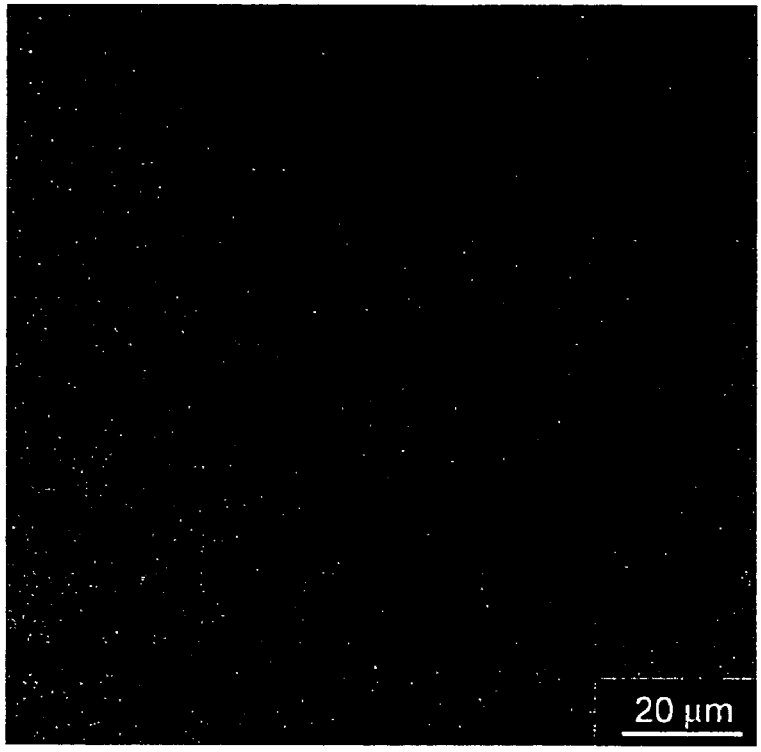
FIG. 9E is another scanning electron micrograph at 1000× magnification of an intermediate layer of a three-layer shot formed according to one embodiment of the present invention.
Figure 9F:
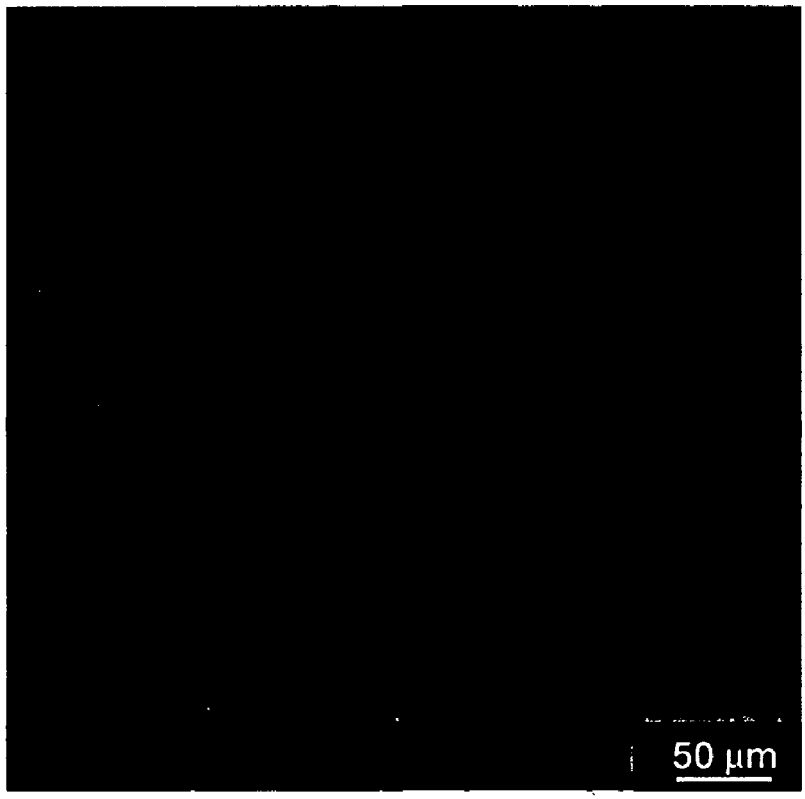
FIG. 9F is a scanning electron micrograph at 300× magnification of the intermediate layer of the three-layer shot of FIG. 9E.

FIG. 9A is a scanning electron micrograph at 1000× magnification of an intermediate layer of a three-layer shot formed according to the second embodiment of the present invention. This shot has an aggregate density of about 11 g/cm$^3$, with a intermediate layer density of about 13.76 g/cm$^3$ and a core and surface layer density of about 8.64 g/cm$^3$. The intermediate layer composition comprises about 69 wt % W, about 7 wt % Ni, about 10 wt % Cu and about 14 wt % Fe. The core and surface layer composition comprises about 10 wt % W, about 7 wt % Ni, about 20 wt % Cu and about 63 wt % Fe. FIGS. 9B-9D are x-ray maps illustrating tungsten, iron and copper content, respectively, of the intermediate layer, such as described above. FIGS. 9E and 9F are additional scanning electron micrographs at 1000× and 300× magnification, respectively, of the intermediate layer of the three-layer shot. Like the single density shot of FIG. 6A above, the intermediate layer of the three-layer shot has generally circular tungsten-rich grains of substantially the same size (about 10 microns or less), and the grains are generally uniformly distributed.

Figure 9G:
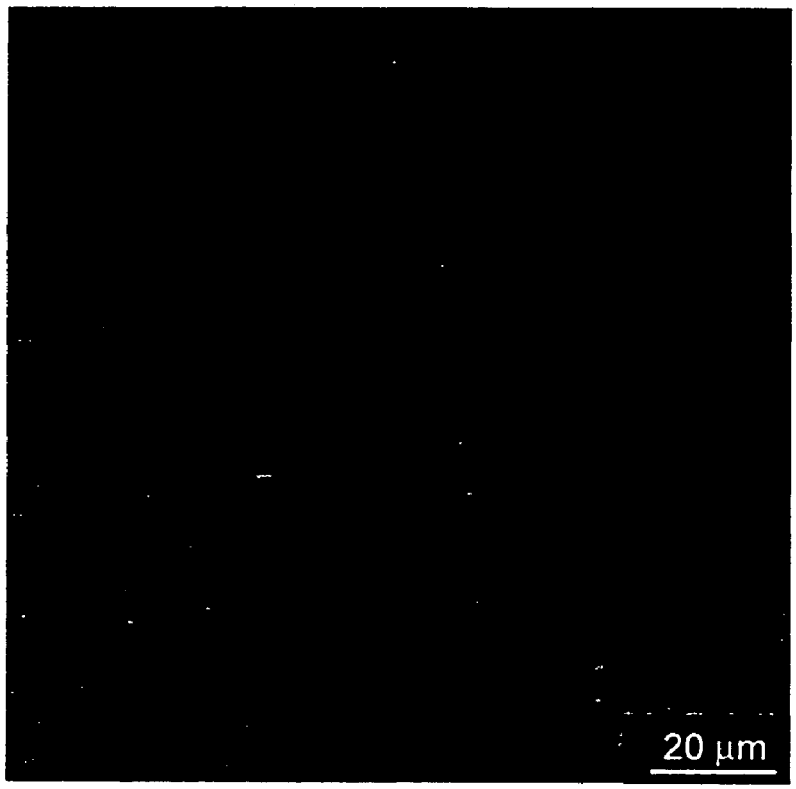
FIG. 9G is a scanning electron micrograph at 1000× magnification of the intermediate layer of the three-layer shot of FIG. 9E, near the intersection with a surface layer.
Figure 9H:
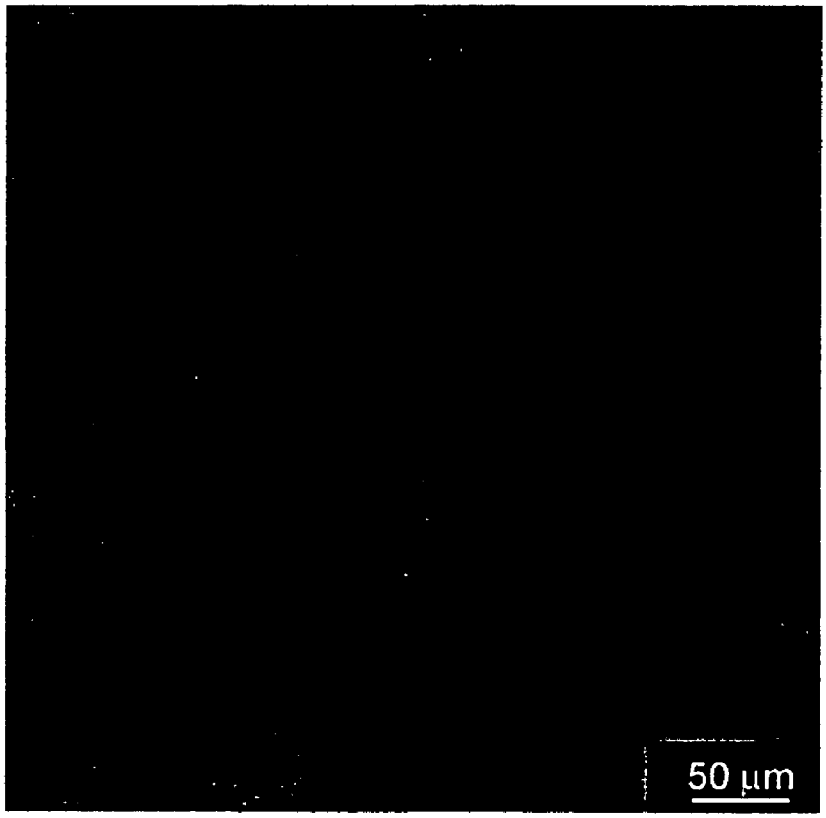
FIG. 9H is a scanning electron micrograph at 300× magnification at about the intersection of the intermediate layer and the surface layer of the three-layer shot of FIG. 9G.
Figure 9I:
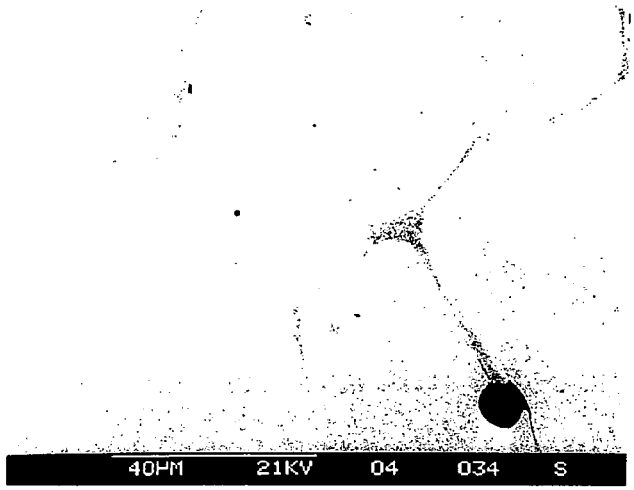
FIGS. 9I and 9J are scanning electron micrographs at 1000× magnification of the surface layer of the three-layer shot of FIG. 9E.
Figure 9J:
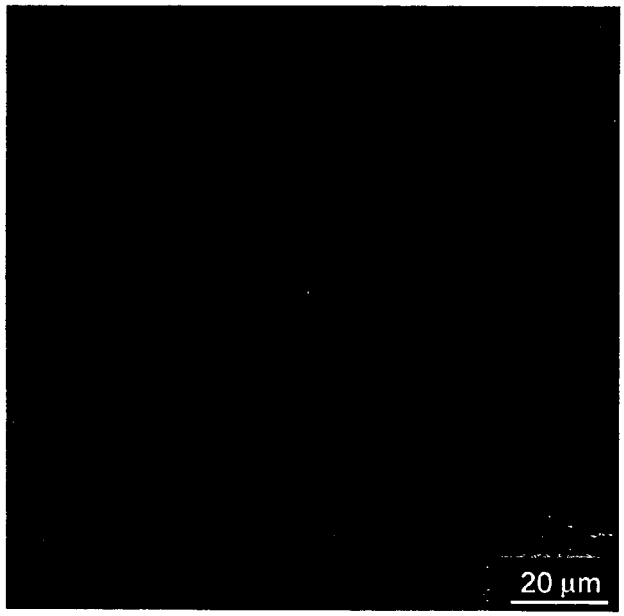

FIG. 9G shows a scanning electron micrograph at 1000× magnification of the intermediate layer near the interface with the surface layer. FIG. 9H is a scanning electron micrograph at 300× magnification showing both the intermediate and the surface layers, with the core being shown on the left. FIGS. 9I and 9J are scanning electron micrographs at 1000× magnification showing the surface layer. The core of the three-layer shot would appear similar.

Figure 10A:
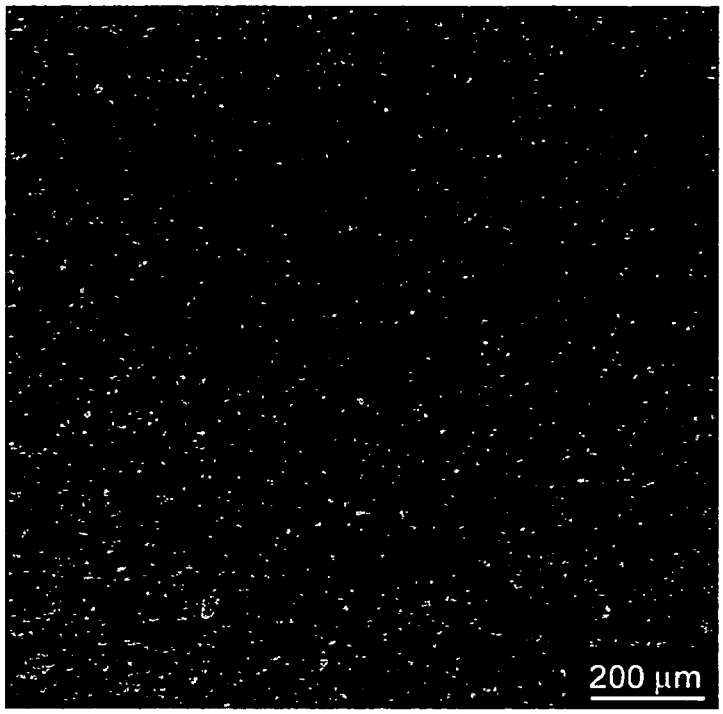
FIGS. 10A-10E show scanning electron micrographs at 100× magnification of a compacted tungsten-iron sample.
Figure 10B:
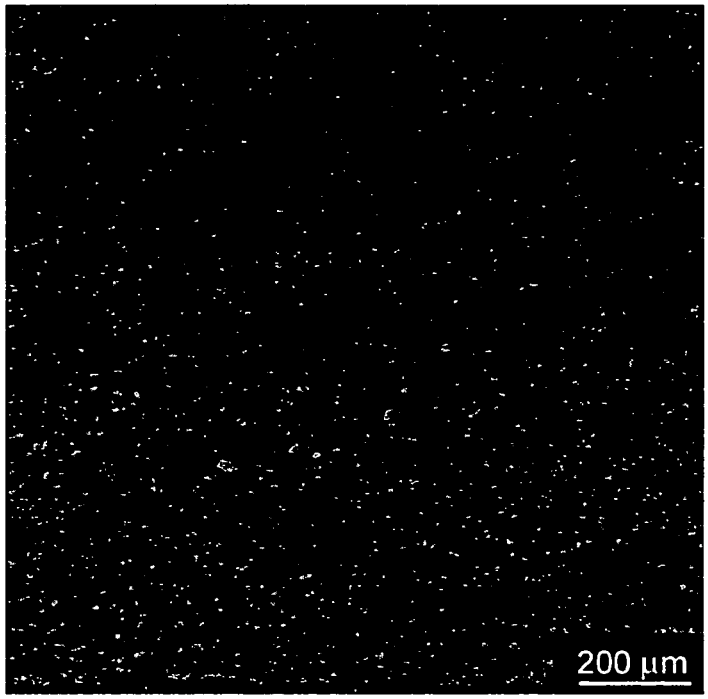
Figure 10C:
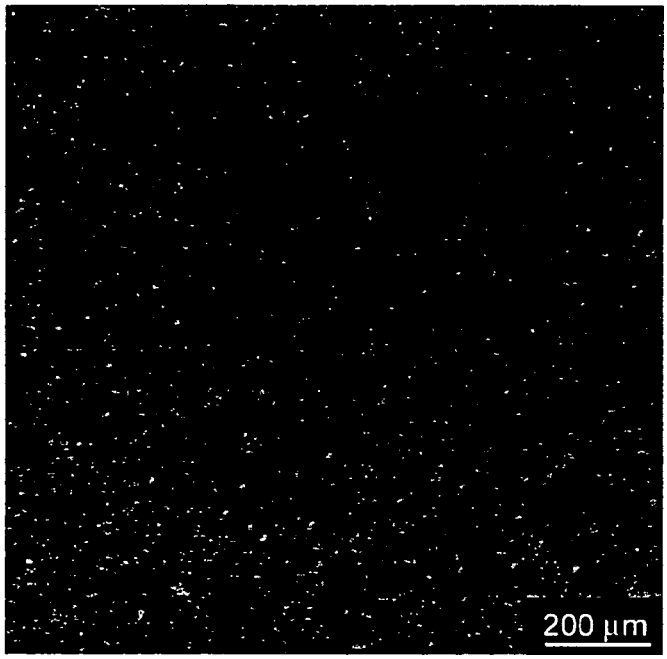
Figure 10D:
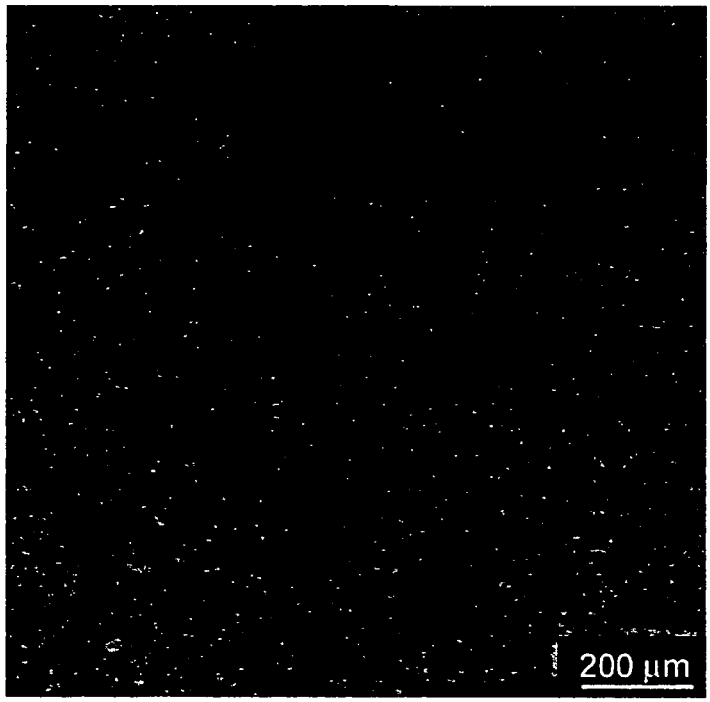
Figure 10E:
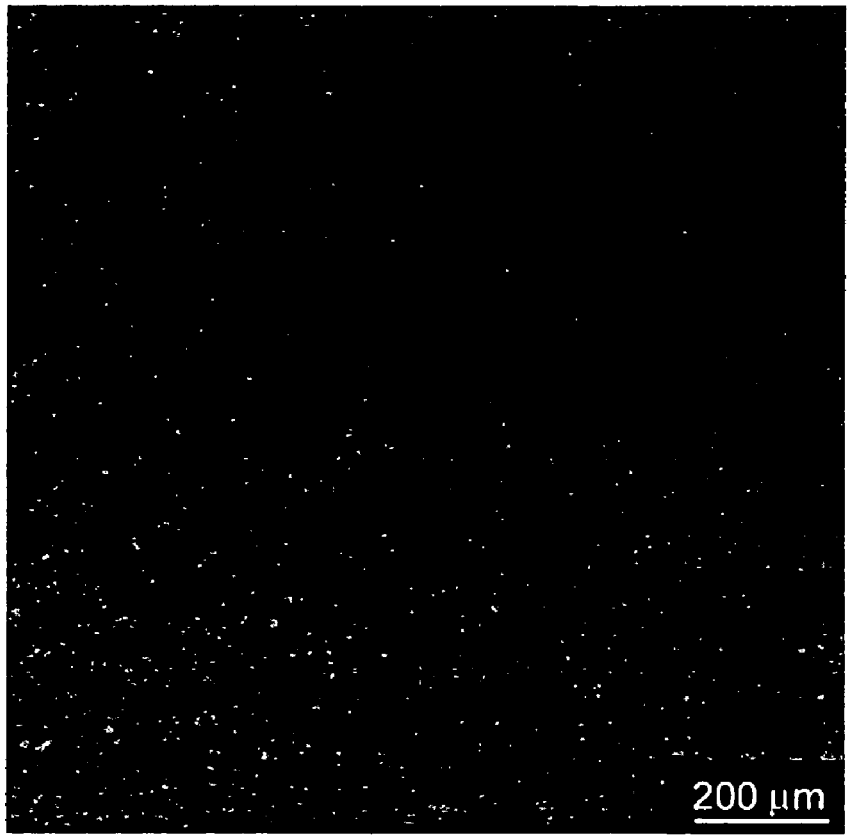
Figure 10F:
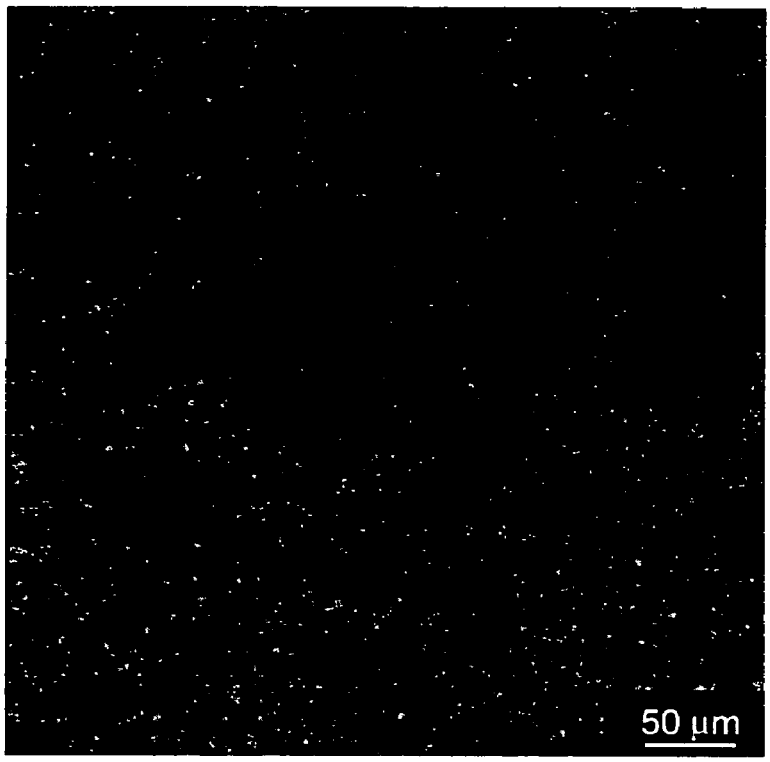
FIG. 10F is a scanning electron micrograph at 300× magnification of the compacted tungsten-iron sample of FIGS. 10A-10E.
Figure 10G:
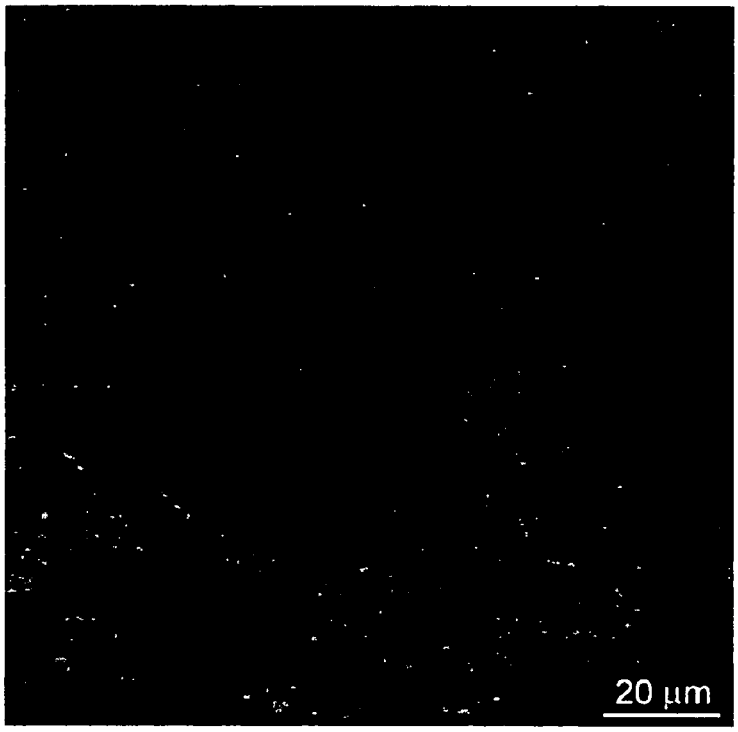
FIG. 10G is a scanning electron micrograph at 1000× magnification of the compacted tungsten-iron sample of FIGS. 10A-10E.
Figure 10H:
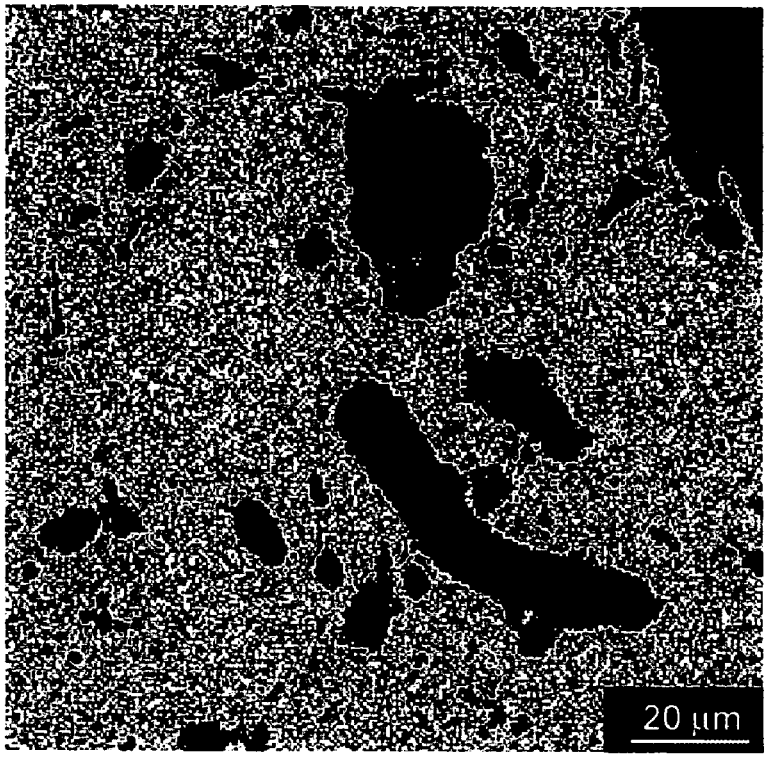
FIG. 10H is an x-ray map of the sample of FIG. 10G, illustrating iron content.
Figure 10I:
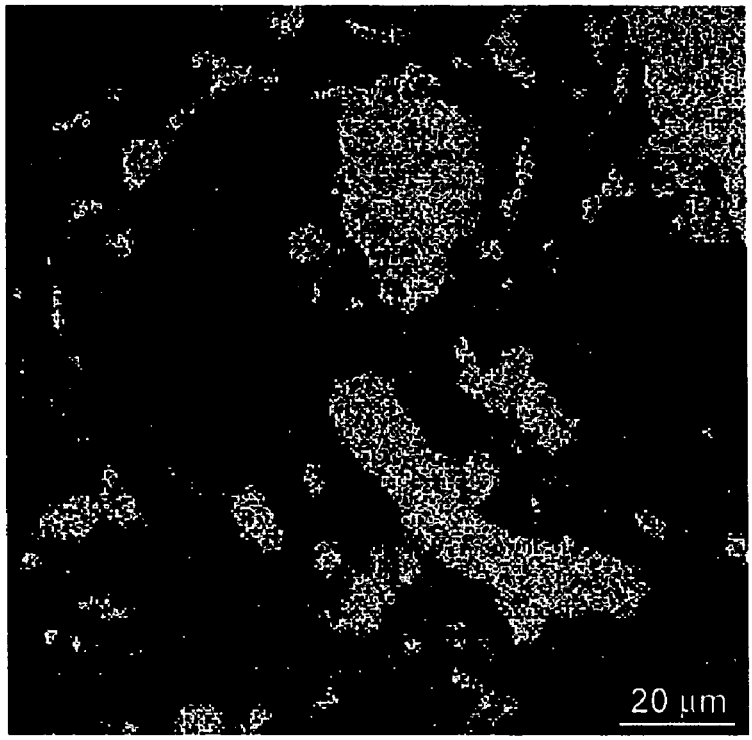
FIG. 10I is an x-ray map of the sample of FIG. 10G, illustrating tungsten content.

Shots produced according the methods described above compare favorably to shots formed by prior art processes such as by compacting. FIGS. 10A-10E are scanning electron micrographs at 100× (taken at five locations of the sample), FIG. 10F at 300× magnification, and FIG. 10G at 1000× magnification, of a compacted tungsten-iron sample, containing 30 wt. % W and 70 wt. % Fe. The sample was compacted at 100 ksi, and sintered at 900° C., producing a sample with a density of 7.81 g/cm$^3$. FIG. 10H is an x-ray map of the sample illustrating iron content, and FIG. 10I is an x-ray map of the sample illustrating tungsten content. Comparing this sample to the non-compacted shots as described above, it will be appreciated that the grains of the shots produced according to preferred embodiments of the invention have smaller grains that are much more uniformly distributed and uniform in grain size.

Figure 11A:
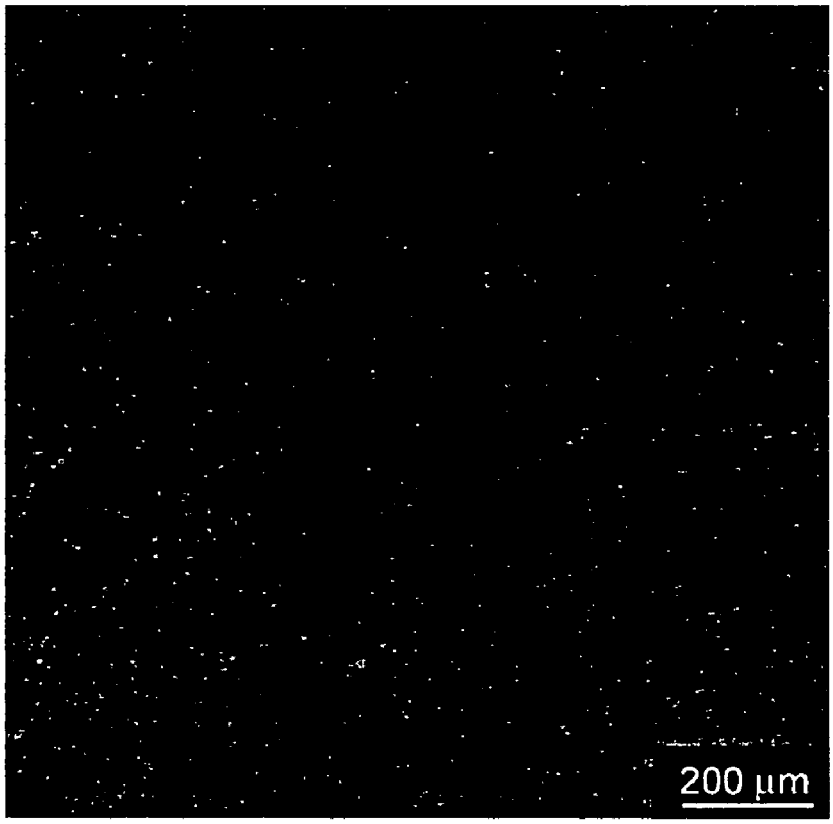
FIGS. 11A-11E show scanning electron micrographs at 100× magnification of a compacted tungsten-copper sample.
Figure 11B:
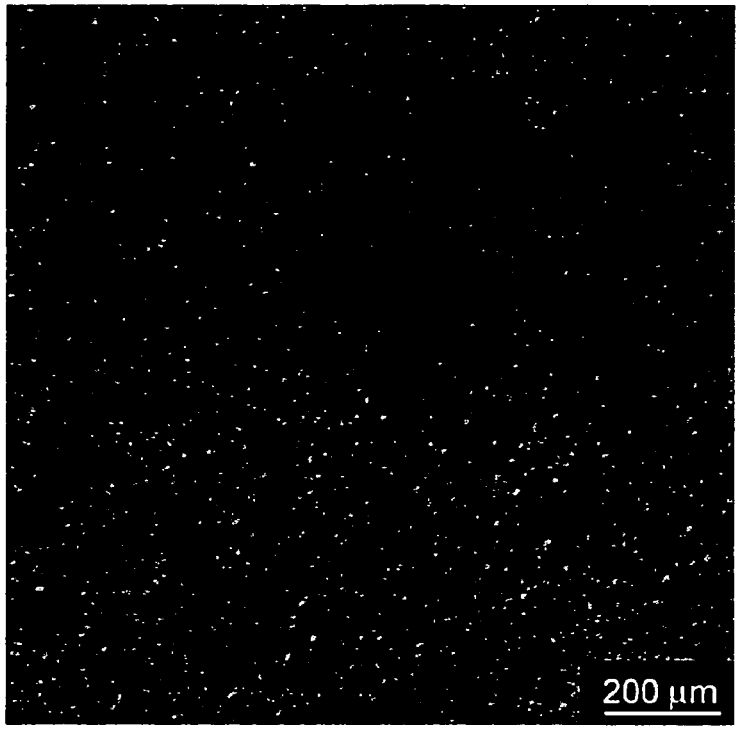
Figure 11C:
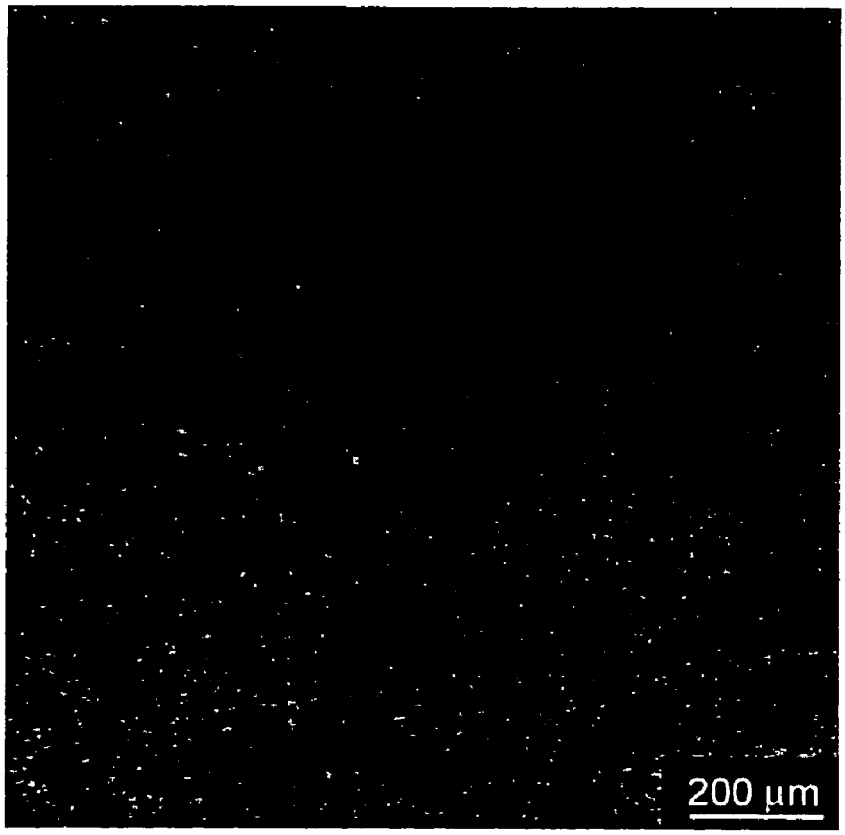
Figure 11D:
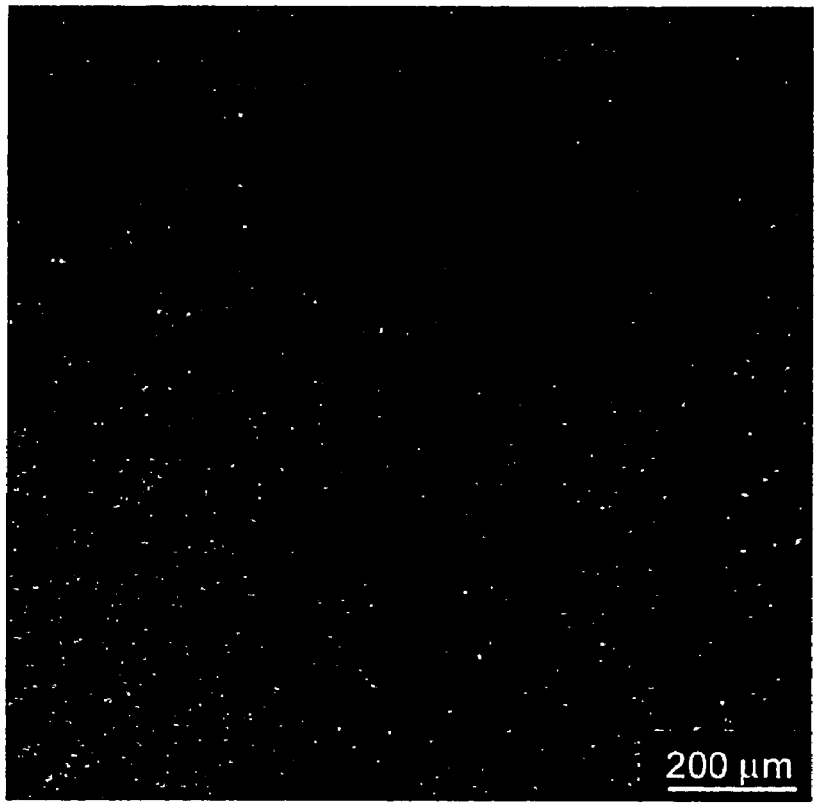
Figure 11E:
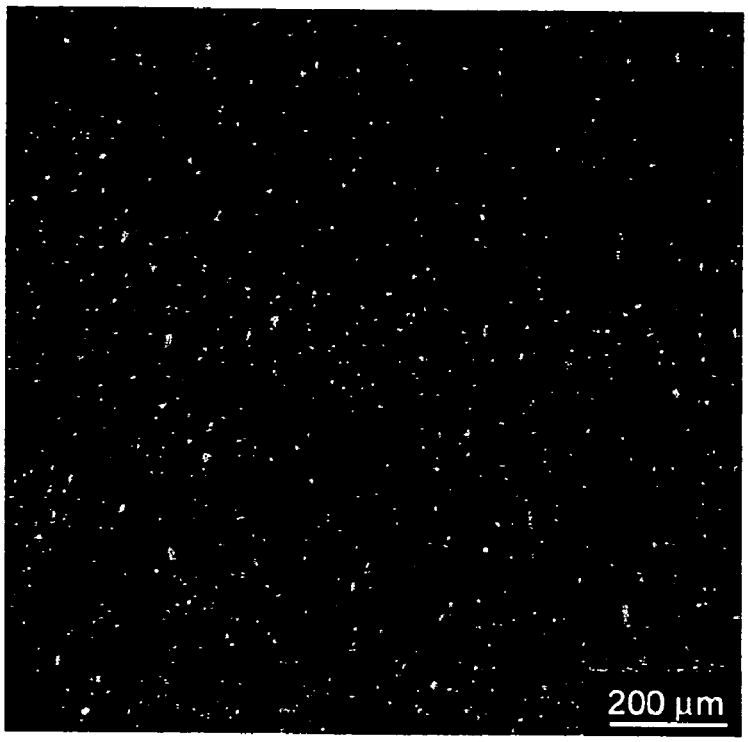
Figure 11F:
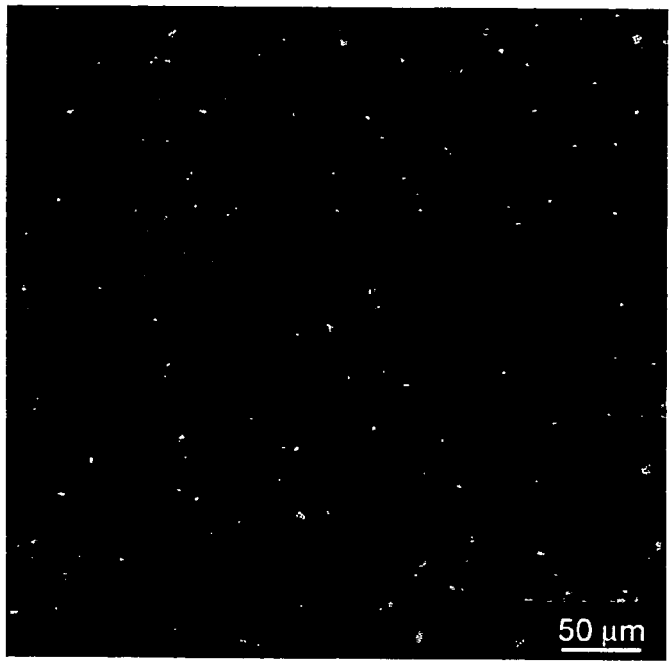
FIG. 11F is a scanning electron micrograph at 300× magnification of the compacted tungsten-copper sample of FIGS. 11A-11G.
Figure 11G:
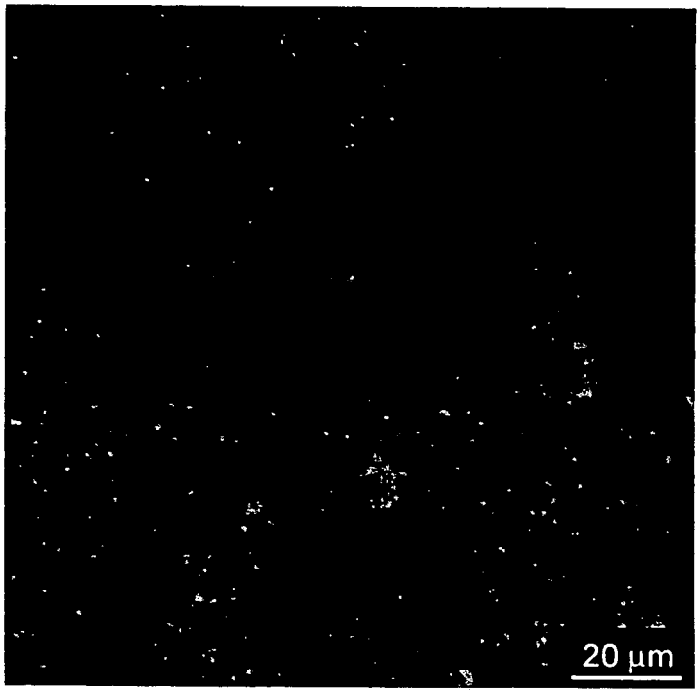
FIG. 11G is a scanning electron micrograph at 1000× magnification of the compacted tungsten-copper sample of FIG. 11A-11E.
Figure 11H:
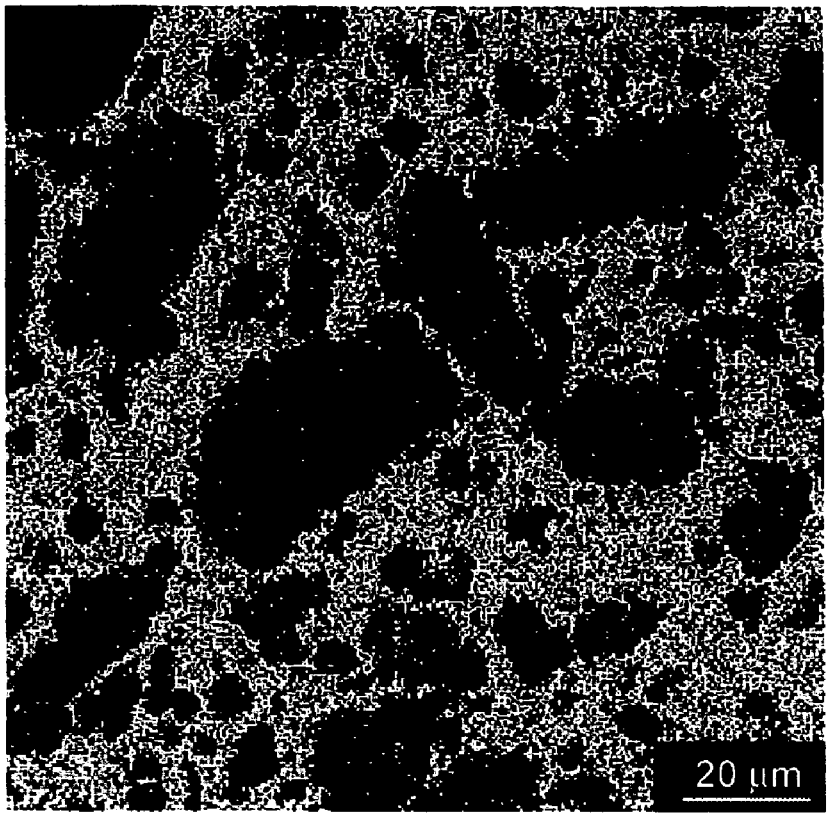
FIG. 11H is an x-ray map of the sample of FIG. 11G, illustrating copper content.
Figure 111:
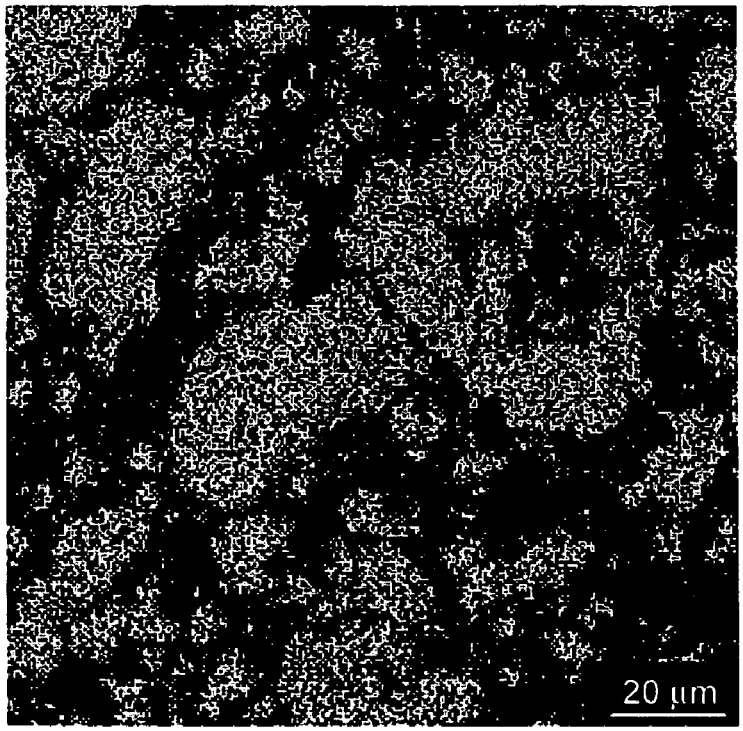

FIGS. 11A-11E are scanning electron micrographs at 100× (taken at five locations of the sample), FIG. 11F at 300× magnification, and FIG. 11G at 1000× magnification, of a compacted tungsten-iron sample, containing 43 wt. % W and 57 wt. % Cu. The samples were compacted at 100 ksi, and sintered at 900° C., producing a sample with a density of 9.43 g/cm$^3$. FIG. 11H is an x-ray map of the sample illustrating copper content, and FIG. 11I is an x-ray map of the sample illustrating tungsten content. As with the sample of FIGS. 10A-10G, comparing this sample to the shots as described above, it will be appreciated that the grains of the shots produced according to preferred embodiments of the invention have smaller grains that are much more uniformly distributed and uniform in grain size.

Figure 12A:
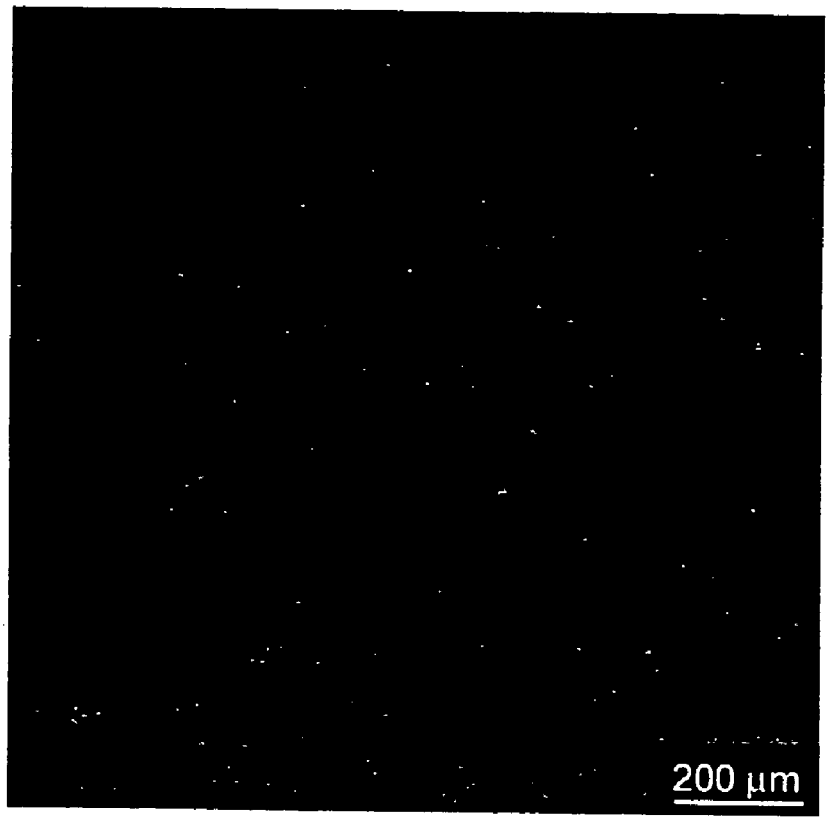
FIGS. 12A-12E show scanning electron micrographs at 100× magnification of a compacted tungsten-iron-nickel-copper sample.
Figure 12B:
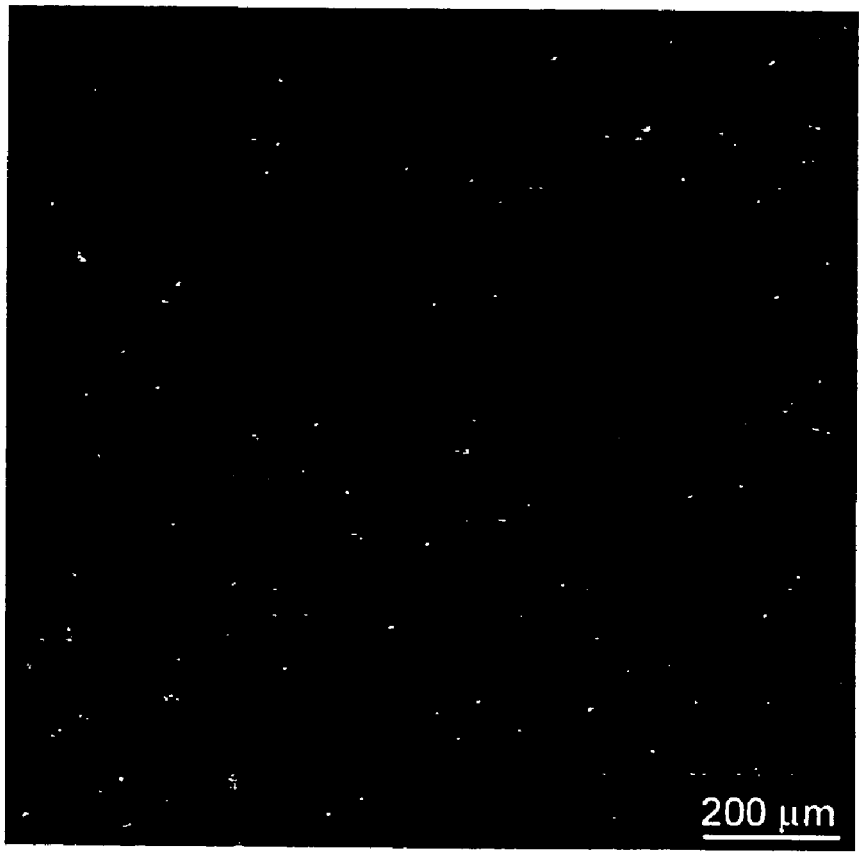
Figure 12C:
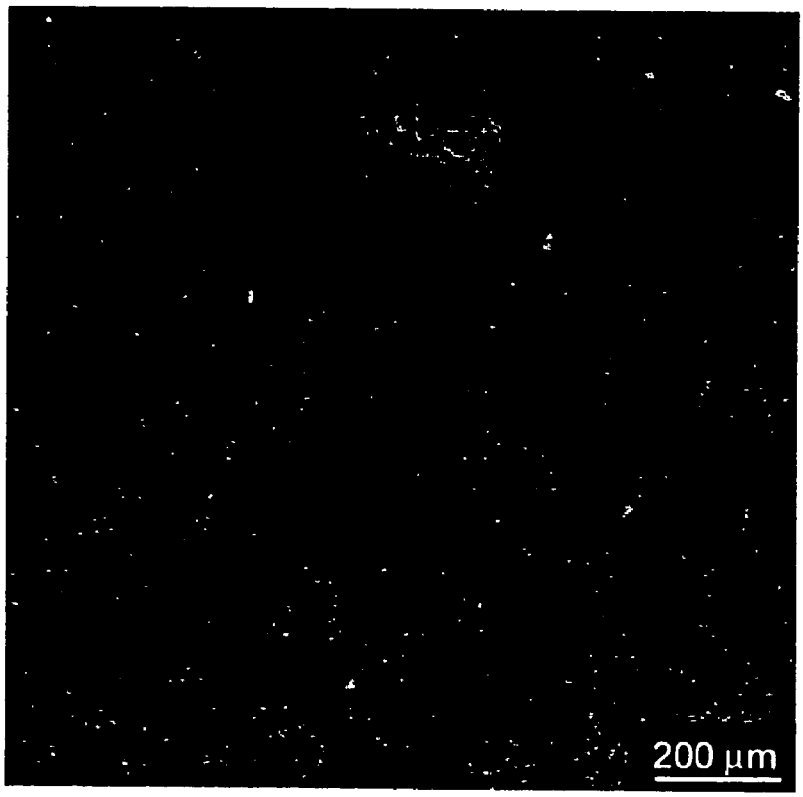
Figure 12D:
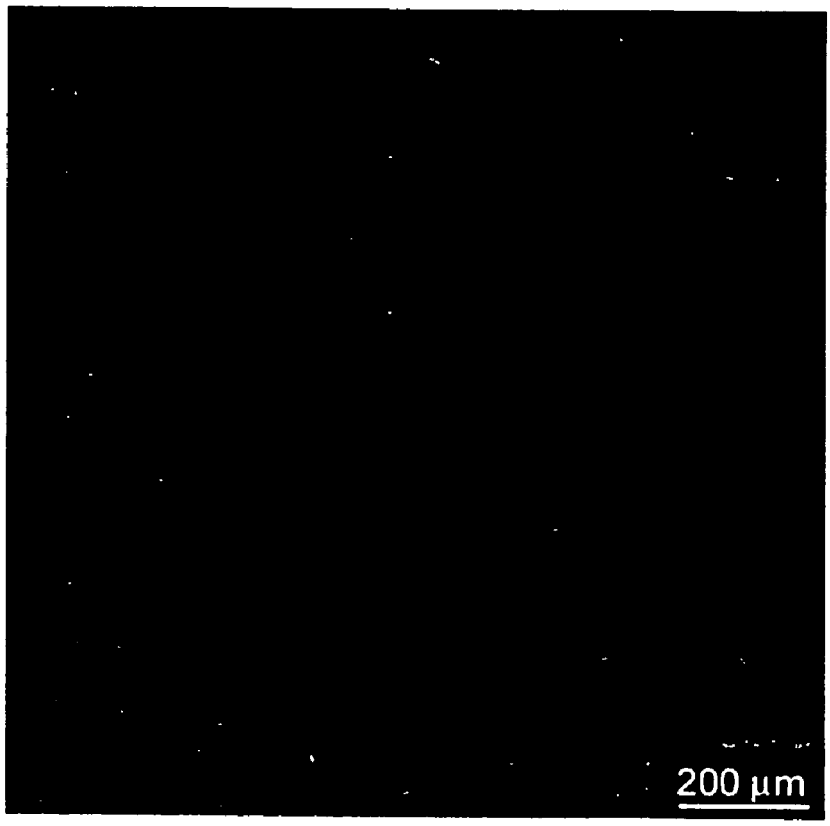
Figure 12E:
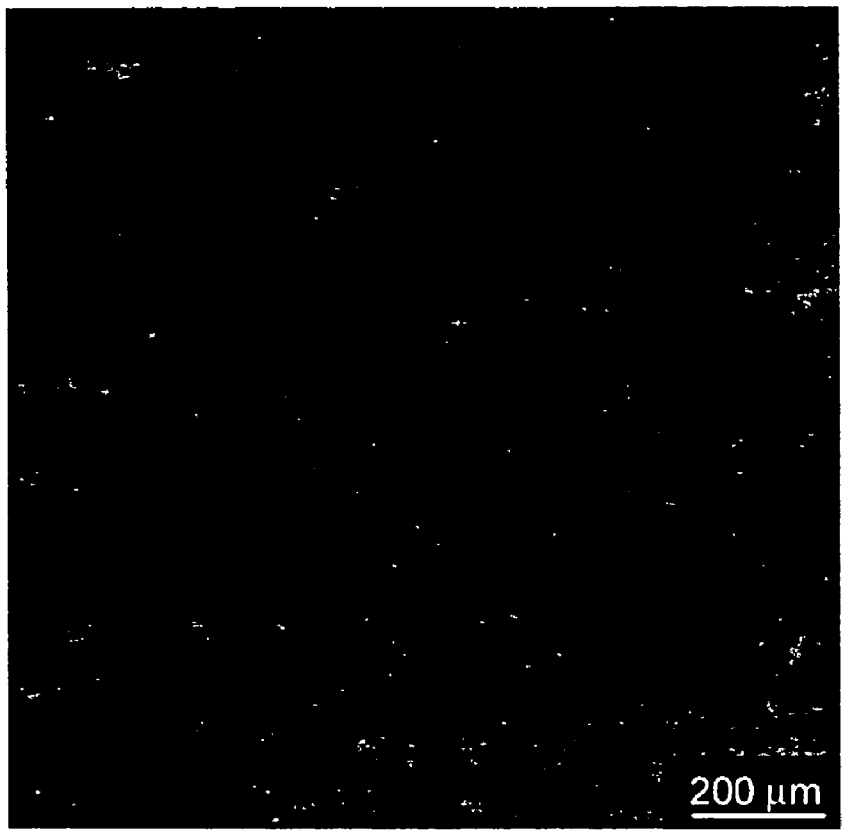
Figure 12F:
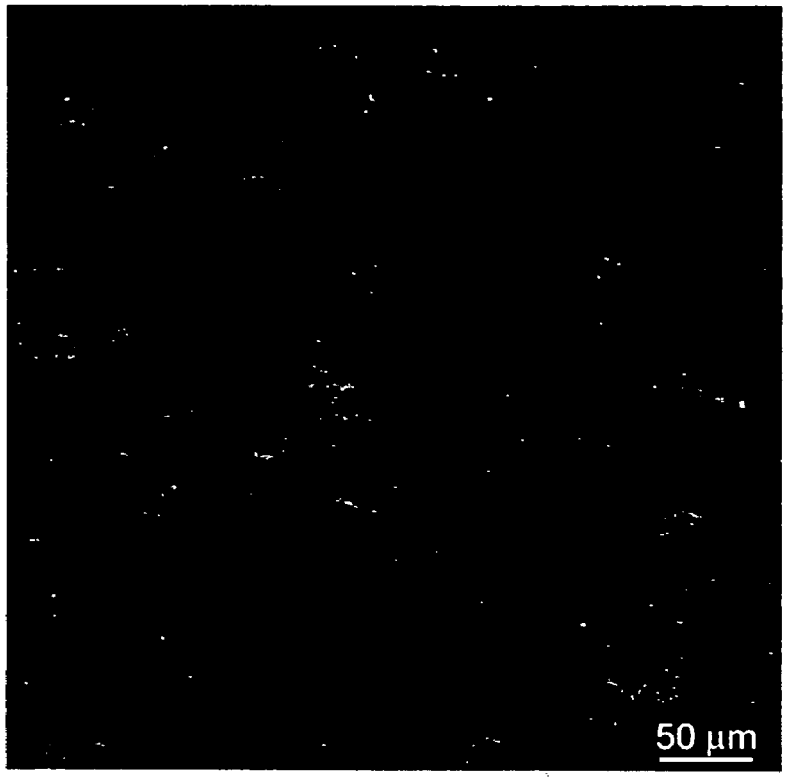
FIG. 12F is a scanning electron micrograph at 300× magnification of the compacted tungsten-iron-nickel-copper sample of FIGS. 12A-12E.
Figure 12G:
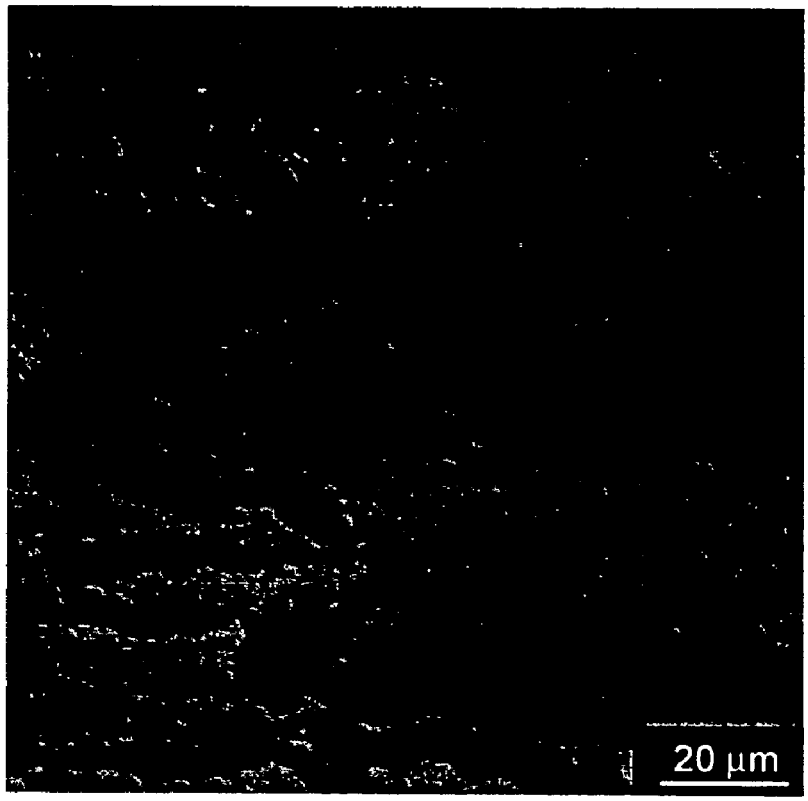
FIG. 12G is a scanning electron micrograph at 1000× magnification of the compacted tungsten-iron-nickel-copper sample of FIGS. 12A-12E.
Figure 12H:
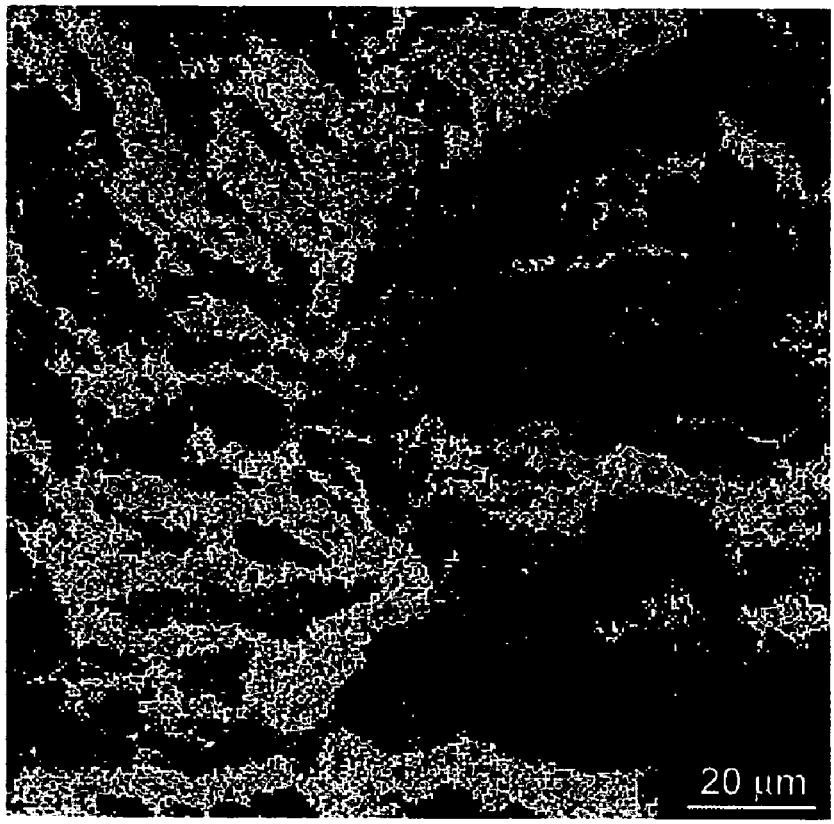
FIG. 12H is an x-ray map of the sample of FIG. 12G, illustrating iron content.
Figure 121:
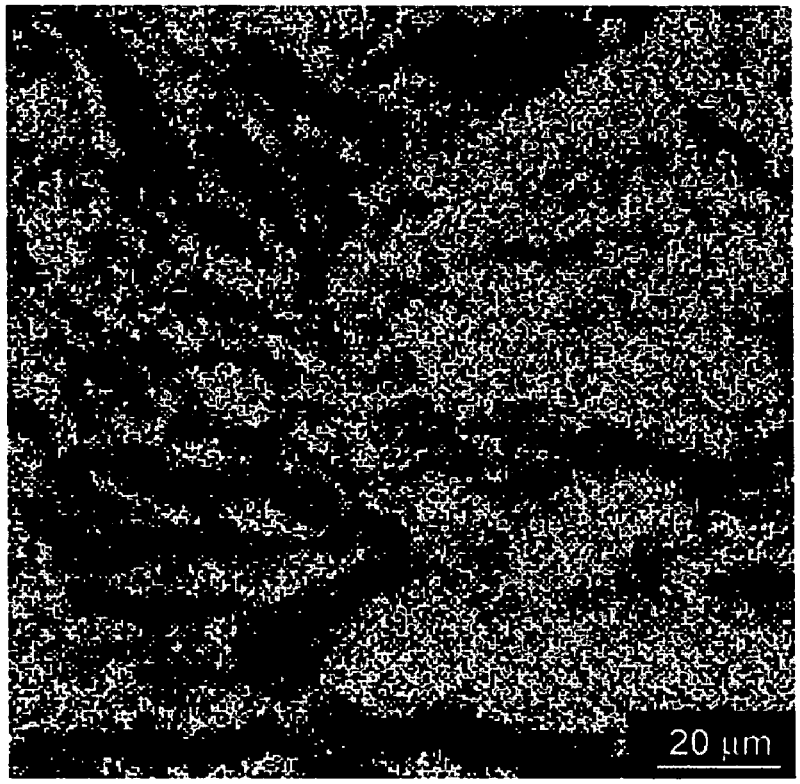
Figure 12J:
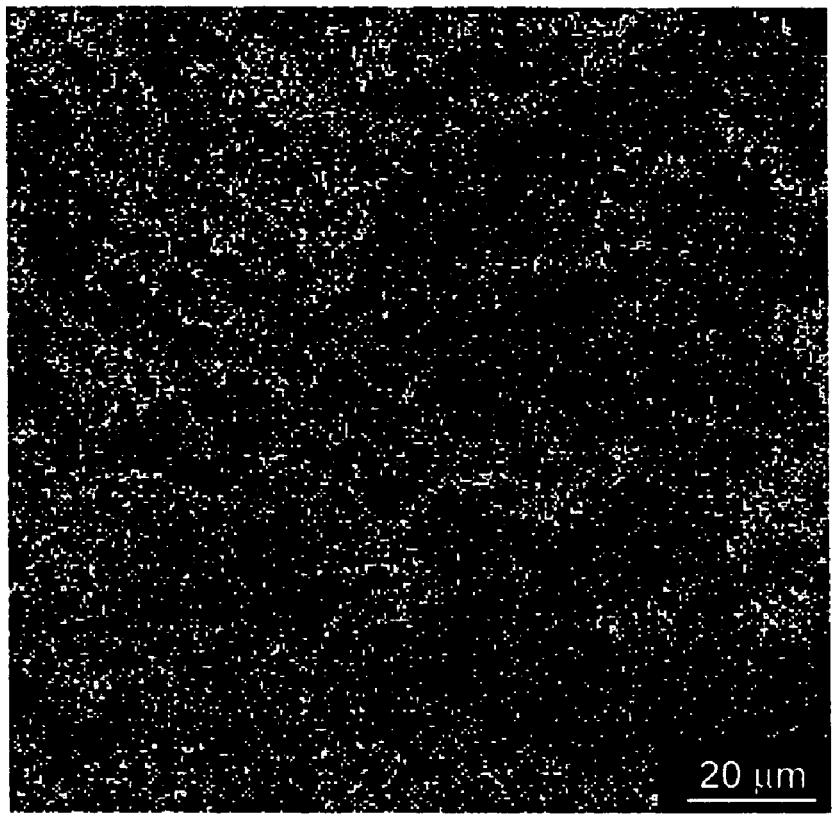
FIG. 12J is an x-ray map of the sample of FIG. 12G, illustrating nickel content.
Figure 12K:
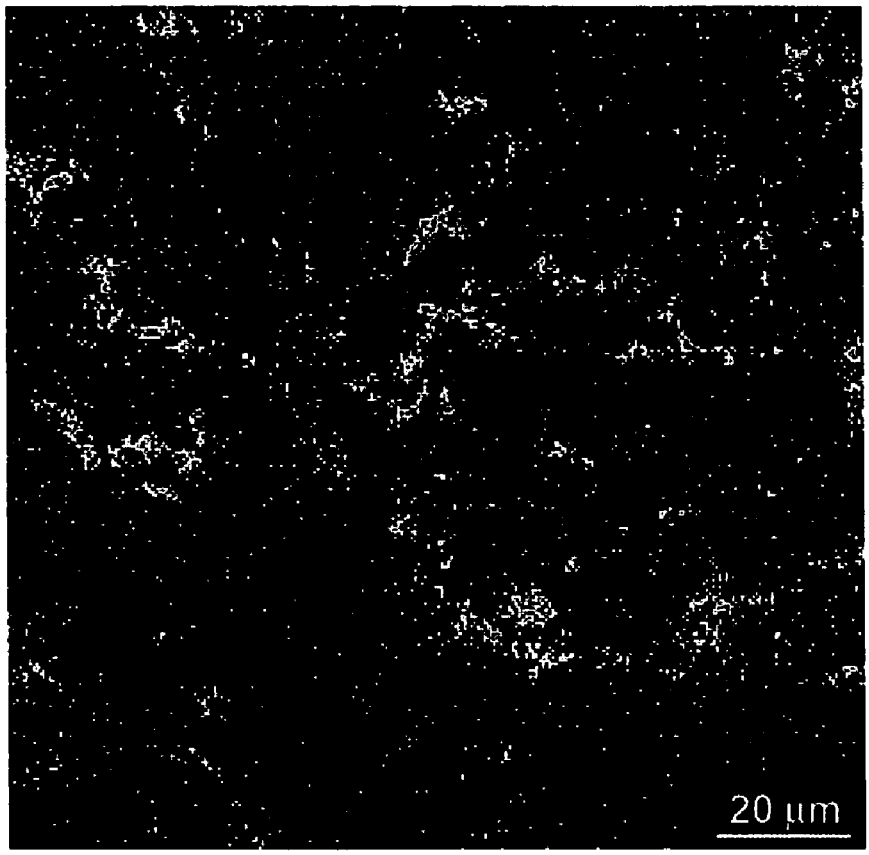
FIG. 12K is an x-ray map of the sample of FIG. 12G, illustrating copper content.

FIGS. 12A-12E are scanning electron micrographs at 100× (taken at five locations of the sample), FIG. 12F at 300× magnification, and FIG. 12G at 1000× magnification, of a compacted tungsten-iron sample, containing 69 wt. % W, 16 wt. % Fe, 6 wt. % Ni and 9 wt. % Cu. The sample was compacted at 100 ksi, and sintered at 900° C., producing a sample with a density of 10.70 g/cm$^3$. FIG. 12H is an x-ray map of the sample illustrating iron content, FIG. 12I is an x-ray map of the sample illustrating tungsten content, FIG. 12J is an x-ray map of the sample illustrating nickel content, and FIG. 12K is an x-ray map of the sample illustrating copper content. These figures demonstrate that the components, particularly the iron, tungsten and copper constituents, are not substantially uniformly distributed, and the grains are not generally circular or uniform in size. Comparing them in particular to the intermediate layer of the shot shown in FIG. 9A, it can be seen that shots formed according to preferred embodiments of the invention have grains that are smaller, generally more circular, more uniform in size and more evenly distributed.

Figure 13A:
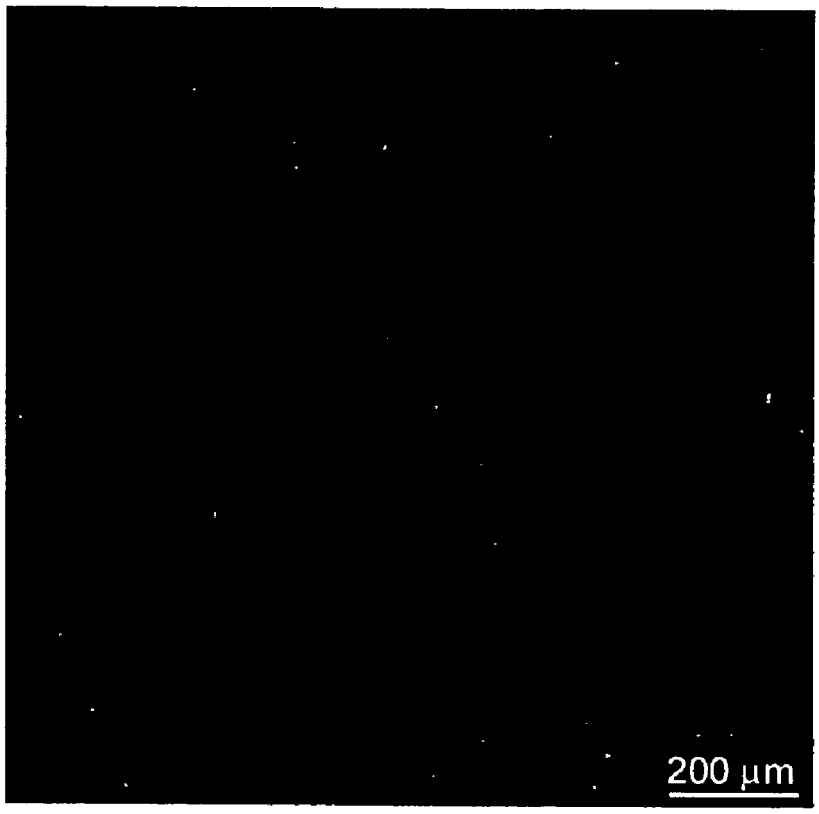
FIGS. 13A-13E show scanning electron micrographs at 100× magnification of another compacted tungsten-iron-nickel-copper sample.
Figure 13B:
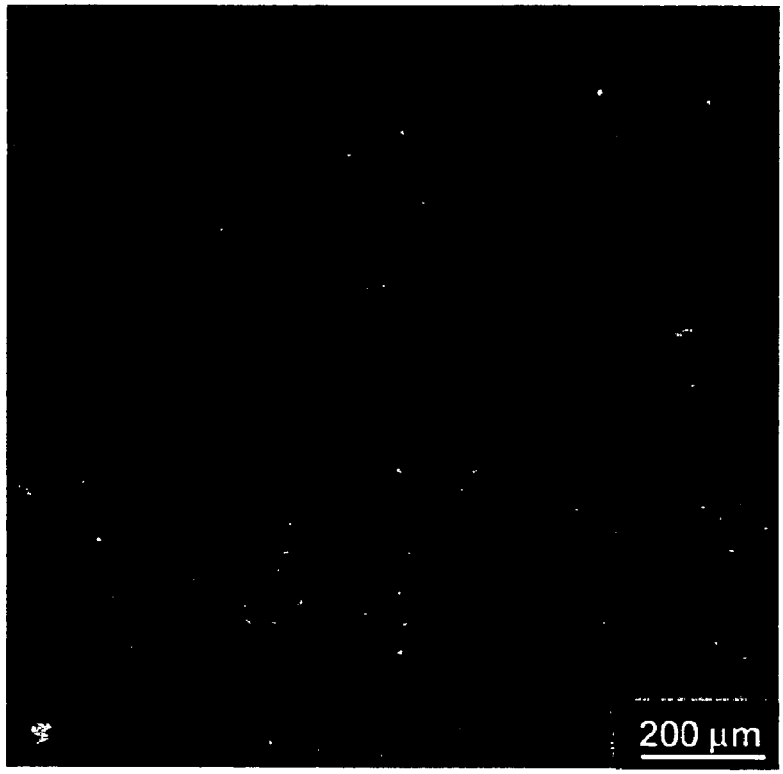
Figure 13C:
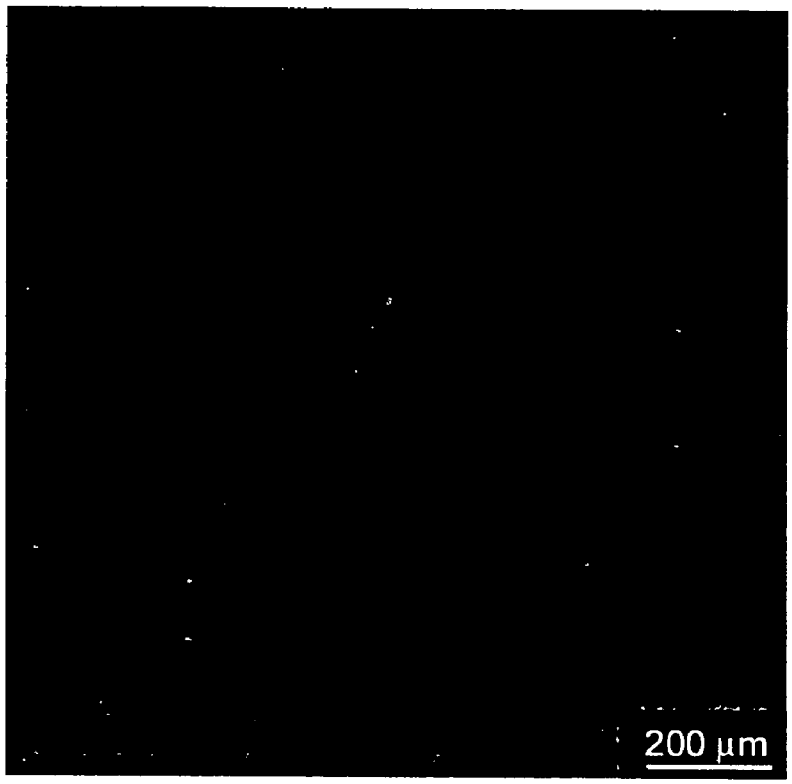
Figure 13D:
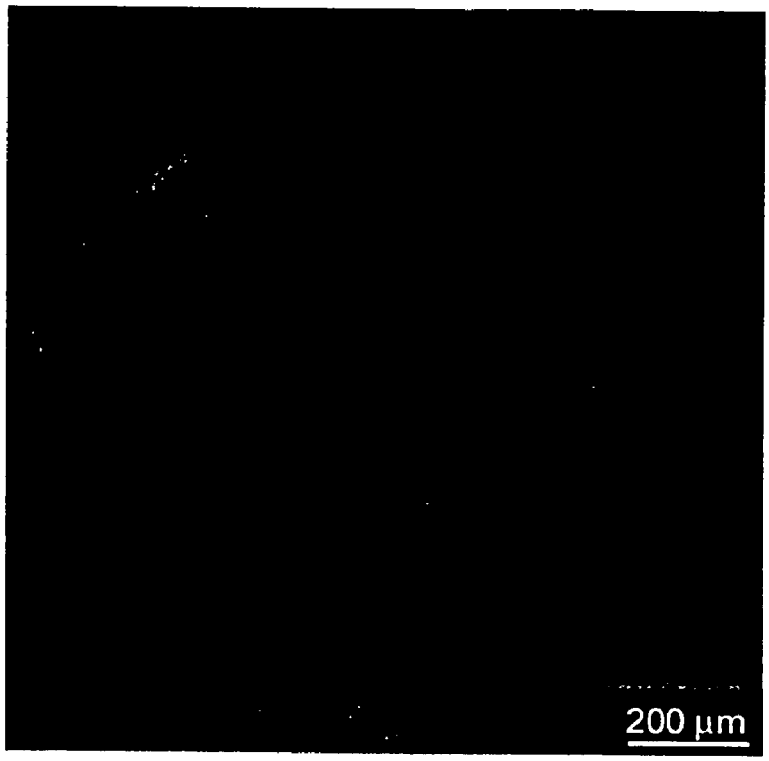
Figure 13E:
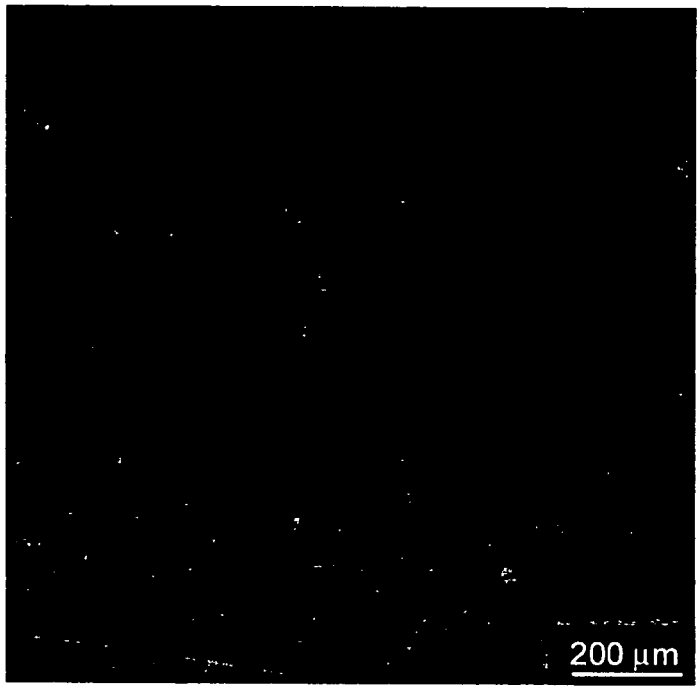
Figure 13F:
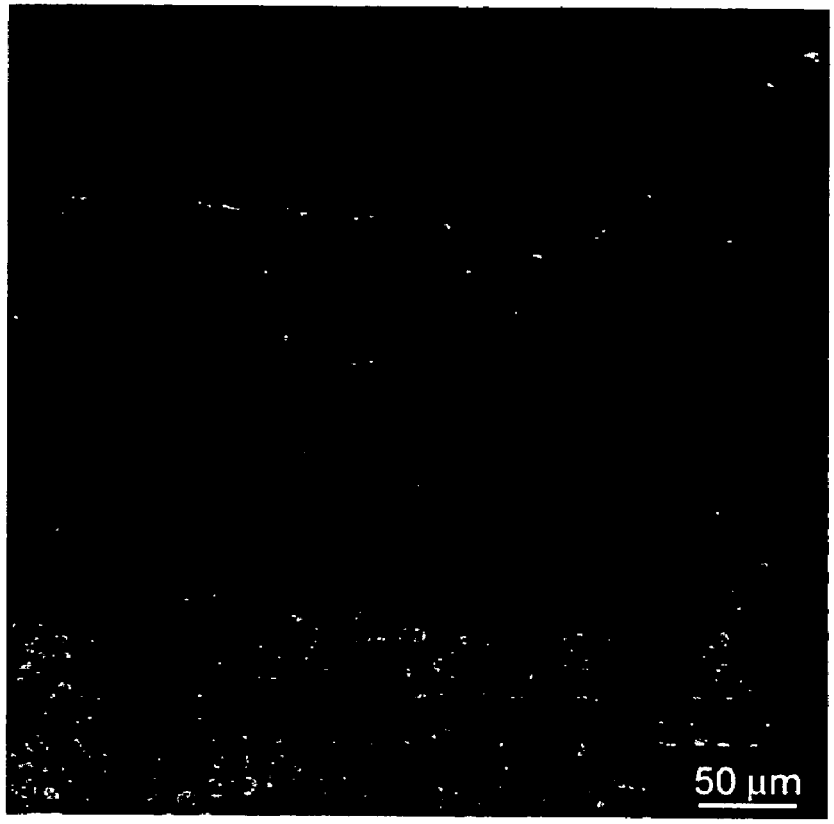
FIG. 13F is a scanning electron micrograph at 300× magnification of the compacted tungsten-iron-nickel-copper sample of FIGS. 13A-13E.
Figure 13G:
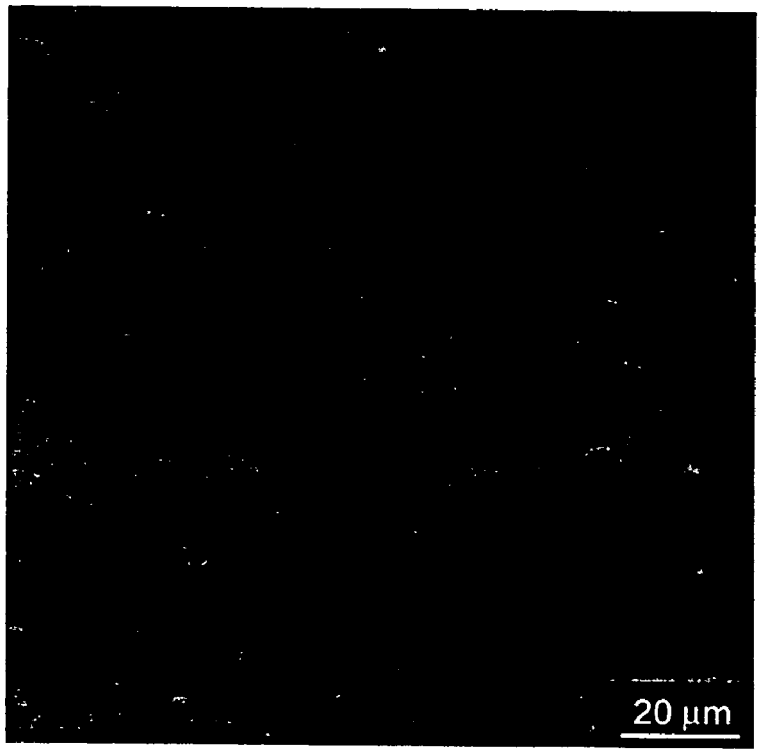
FIG. 13G is a scanning electron micrograph at 1000× magnification of the compacted tungsten-iron-nickel-copper sample of FIGS. 13A-13E.
Figure 13H:
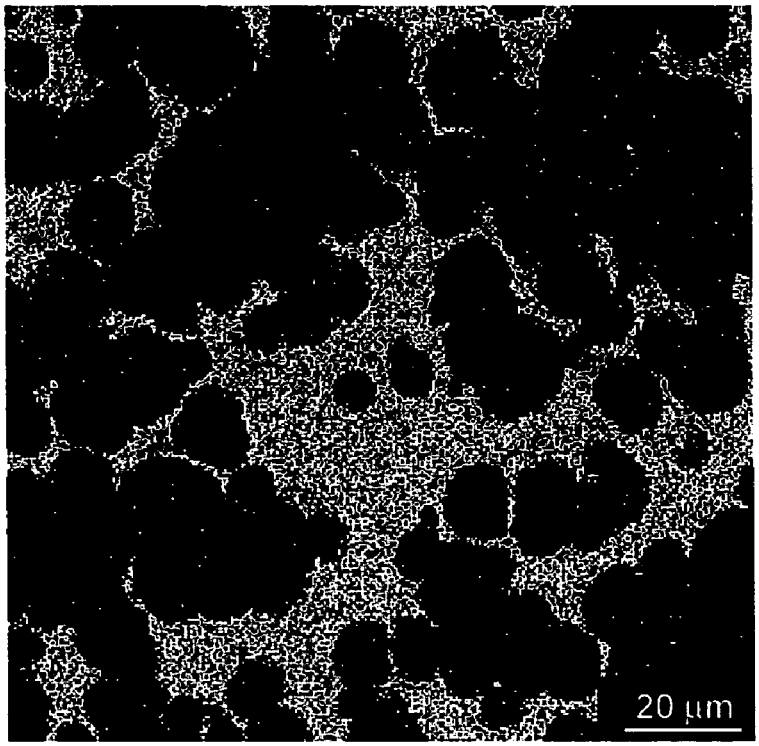
FIG. 13H is an x-ray map of the sample of FIG. 13G, illustrating iron content.
Figure 131:
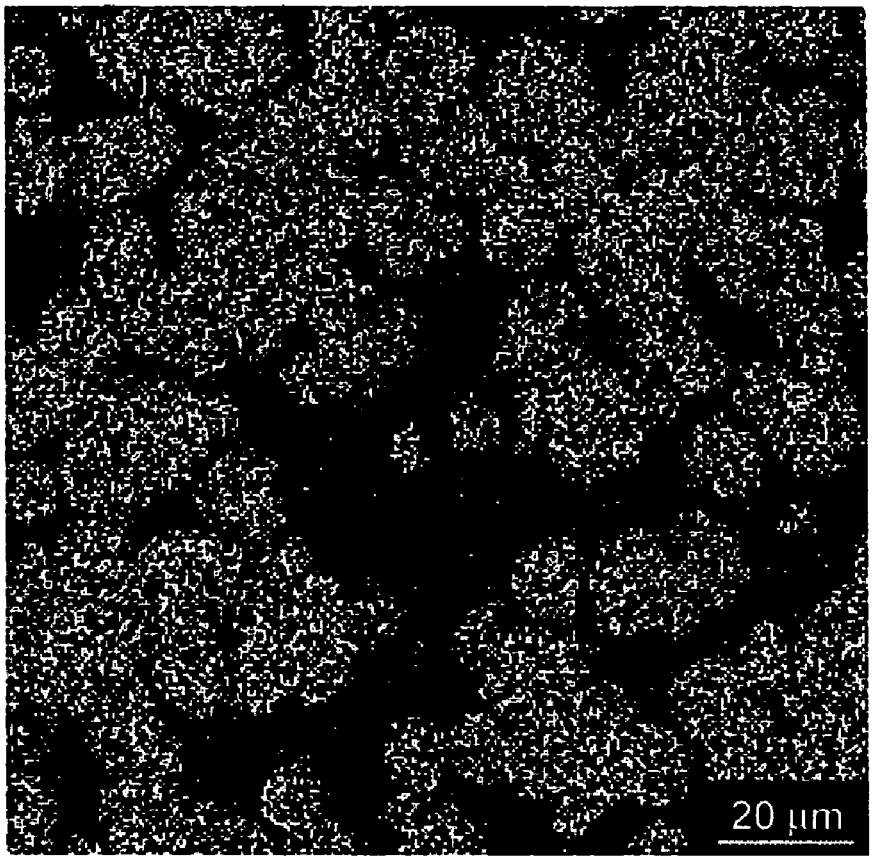
Figure 13J:
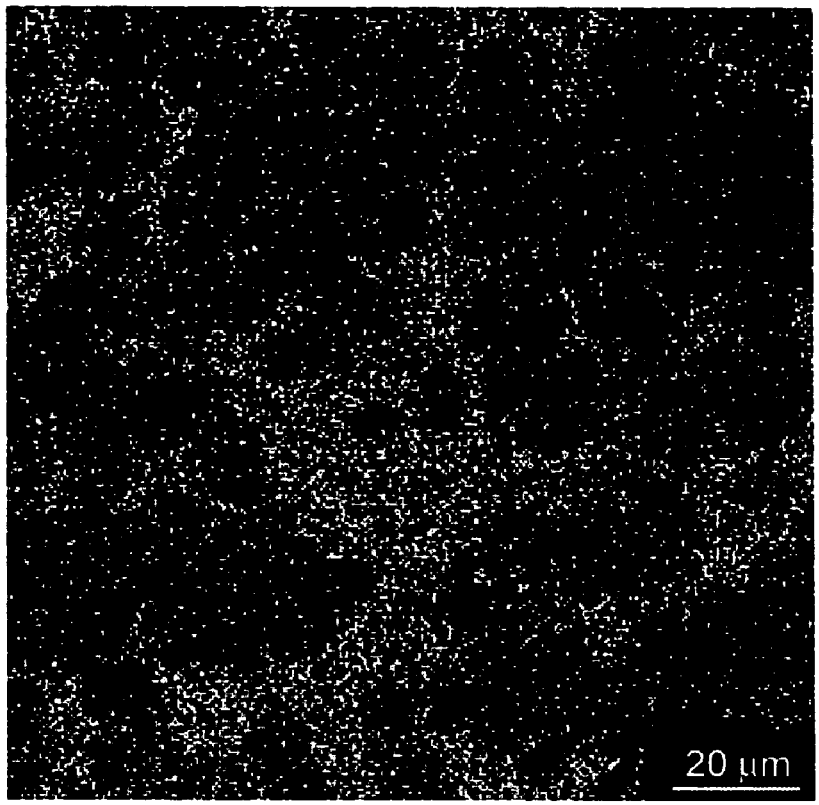
FIG. 13J is an x-ray map of the sample of FIG. 13G, illustrating nickel content.
Figure 13K:
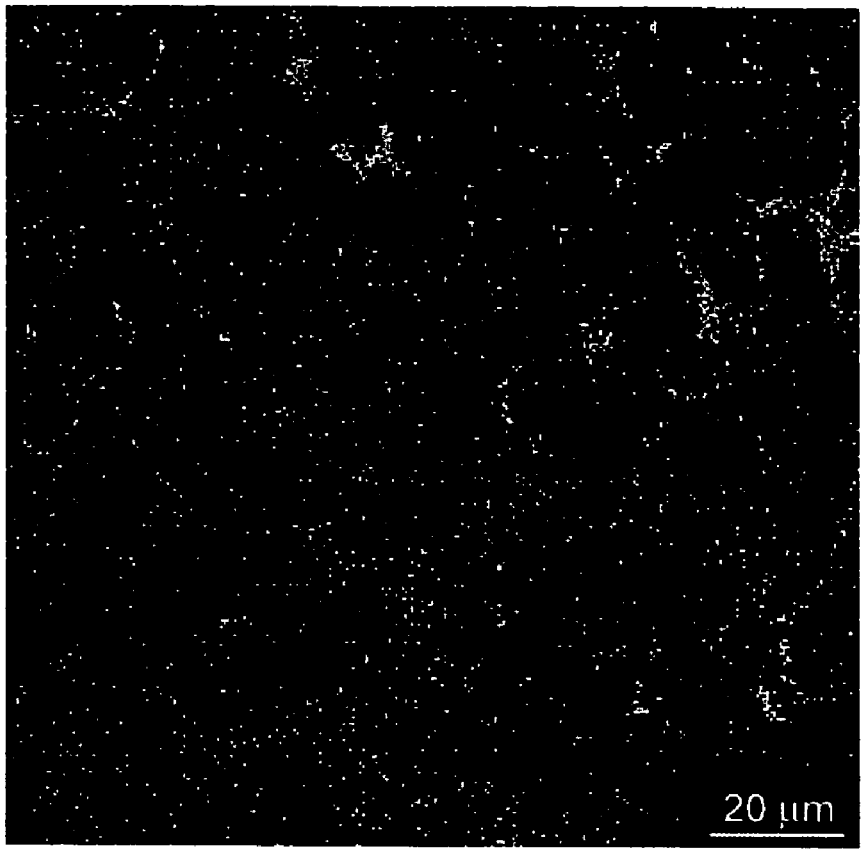
FIG. 13K is an x-ray map of the sample of FIG. 13G, illustrating copper content.

FIGS. 13A-13E are scanning electron micrographs at 100× (taken at five locations of the sample), FIG. 13F at 300× magnification, and FIG. 13G at 1000× magnification, of a compacted tungsten-iron sample, containing 69 wt. % W, 16 wt. % Fe, 6 wt. % Ni and 9 wt. % Cu. The sample was compacted at 100 ksi, and sintered at 1368° C., producing a sample with a density of 13.44 g/cm$^3$. FIG. 13H is an x-ray map of the sample illustrating iron content, FIG. 13I is an x-ray map of the sample illustrating tungsten content, FIG. 13J is an x-ray map of the sample illustrating nickel content, and FIG. 13K is an x-ray map of the sample illustrating copper content. The grains illustrated are still not as evenly distributed as shown as for the intermediate layer of the shot of FIG. 9A.

Comparing FIGS. 9A and 9G with FIG. 13G in particular, it can be seen the shots formed according to one embodiment of the invention are more dispersely distributed and have a smaller grain size. For example, FIGS. 9A and 9G show W-rich grains that have an average grain size of less than about 10 microns. The disperse distribution of the grains can be measured by considering that these grains occupy greater than about 80% of any given cross-sectional area of the shot, more preferably greater than about 90%, and even more preferably greater than about 95%.

The grains are also generally uniform in size. For example, preferred embodiments will have about 80% or more of the grains with a diameter less than a desired diameter grain size, for example, about 10 microns. In another embodiment, about 90% or more, or even about 95% or more, of the grains will have diameters less than the desired diameter grain size. The desired diameter grain size may have different values, for example, about 15 microns, about 20 microns, about 25 microns, 30 microns, etc., depending on the composition. In another embodiment, general uniformity in grain size can be determined based on whether a certain percentage of the grains, for example, about 50% or more, about 60% or more, about 70% or more, about 80% or more, about 90% or more, or about 95% or more of the grains, fall within a certain desired range of grain diameters. This range may be, for example, about 10 microns, about 15 microns, about 20 microns, about 25 microns, about 30 microns, etc. It will be appreciated that the agglomeration process described above allows formation of shots having this desired combination of small, disperse, uniform grain size, which is desirable to form shots that are substantially spherical and have uniform desired properties (e.g., hardness, ductility) to improve performance of the shot.

In another embodiment, tungsten carbide scrap can be processed to form tungsten powder suitable for the methods above. Scrap typically contains contaminants such as Co and/or Ti, and comes in large or different sizes that can be difficult to process or sort.

In one embodiment, the scrap can be processed using an electrolysis method, wherein Co, Ni, Fe and Cu are dissolved in solution to obtain WC and TiC in flake shape. The WC and TiC mixture is taken out and put in a sodium nitrate and/or sodium carbonate solution. The reaction will result in a sodium tungstate $NaWO_3$ solution and non-dissolvable titanium oxide TiO, thus separating W and Ti. Sodium tungstate $NaWO_3$ and dihydrate calcium chloride CaCl are then caused to react, resulting in calcium tungstate $CaWO_3$. Calcium tungstate $CaWO_3$ and hydrochloric acid HCl react to result in tungstate $HWO_3$. The tungstate $HWO_3$ is cleaned and dried, and the dried tungstate $HWO_3$ is heated to high temperature to produce tungsten oxide $WO_3$. The tungsten oxide $WO_3$ is reduced to obtain tungsten powder. Further details on tungsten scrap is described in U.S. Pat. No. 6,447,715, the entirety of which is hereby incorporated by reference.

In another embodiment, tungsten carbide itself may be used instead of tungsten as a raw material. For example, the tungsten powder as described above can be replaced with a tungsten carbide powder, and be used as the core in a two-layer or three-layer shot, the intermediate layer in a three-layer shot, or as the primary component in a single layer, uniformly distributed shot. In an embodiment where tungsten carbide is used in the core of a two-layer shot or the intermediate layer of a three-layer shot, the surface layer may be comprised substantially of only Fe and Cu, without substantially any tungsten.

Tungsten carbide advantageously has a density of about 15.7 g/cm$^3$, which desirably provides a high density product. When formed into a multiple-layer composite shot such as described above, the tungsten carbide can be used as a higher density component, which when combined with a lower density component, can provide a desired aggregate density.

It will be appreciated that compositions with combinations of materials other than those described above may be used. For example, in one embodiment zinc is incorporated into the shot. Nickel, copper and zinc powders may be provided to alloy the layers in solid state sintering. Such an embodiment may include about 15% to 35% Ni, about 40% to 60% Cu, and about 20% to 35% Zn.

Embodiments of the shots described above advantageously provide a shot which is extremely uniform in dimension, density, and surface hardness for cartridge loading and therefore superior in density pattern. The processes described above are dedicated processes, with definitive process input and output criteria, enabling mass production of shots. Therefore, there is no limit on the production size. The shots are advantageously as dense as lead alloy or higher. Shots as produced herein may be provided in multiple layers, making them structurally extremely strong and capable of withstanding impact with maximum penetration power. Shots can be provided with a thick, relatively soft outer layer protect the gun barrel.

It will further be appreciated that articles produced with the compositions and/or methods described above can be used in a variety of other applications. For example, embodiments of the present invention may be applicable to technologies involving radiation shields, x-ray marker, counter weights, ballast weights, golf club weights, golf ball cores, fishing weights, and diving belt weights.

It will be understood that the foregoing is only illustrative of the principles of the invention, and that various modifications, alterations, and combinations can be made by those skilled in the art without departing from the scope and spirit of the invention.

What is claimed is:

1. A method of making an ammunition projectile having a predetermined aggregate density, comprising:

selecting one or more constituents in powdered form having a density substantially higher than said predetermined aggregate density;

selecting one or more constituents in powdered form having a density substantially lower than said predetermined aggregate density, wherein in combination, said constituents having densities substantially higher and substantially lower than said predetermined aggregate density provide an aggregate density substantially equal to said predetermined aggregate density;

agitating said powdered constituents with a binding agent to cause said powdered constituents to form pellets; and sintering the pellets to form projectiles having substantially said predetermined aggregate density.

2. The method of claim 1, wherein the powdered constituents having a density substantially higher than said predetermined aggregate density is selected from the group consisting of virgin tungsten, ferrotungsten, tungsten carbide, tungsten alloys and scrap tungsten.

3. The method of claim 1, wherein the powdered constituents having a density substantially lower than said predetermined aggregate density is selected from the group consisting of Fe, Ni, Cu and combinations thereof.

4. The method of claim 1, wherein the powdered constituents are agitated using an agitator selected from the group consisting of a drum, disk, dish and pan.

5. The method of claim 1, wherein agitating said powdered constituents with a binding agent causes the pellets to agglomerate in generally uniform layers.

6. The method of claim 1, wherein the predetermined aggregate density is about 10 to 15.5 g/cm$^3$.

7. The method of claim 1, wherein the sintered projectiles have a diameter in the range of 0.070" to 0.220".

8. The method of claim 1, wherein sintering the pellets causes the pellets to shrink about 10% to 25%.

9. The method of claim 1, wherein the pellets form projectiles suitable for use as shots in a shotgun shell.

10. The method of claim 1, further comprising agitating distinct mixes of powdered components in stages to form pellets having layers of different compositions.

11. A projectile produced in accordance with claim 1.

12. A method of making spherical shots, comprising:

providing powders comprising tungsten and at least one of copper, iron and nickel;

adding the powders to a mechanical agitator while directing liquid binder into the mechanical agitator; and rotating the agitator while continuing to add the powders, whereby powders wetted by the liquid binder agglomerate to form densified balled materials.

13. The method of claim 12, further comprising screening the densified balled materials to eliminate materials outside of a desired diameter range.

14. The method of claim 12, wherein the powders form densified balled materials having a diameter in the range of about 0.05" to 0.36".

15. The method of claim 12, wherein the powders comprise copper, iron and nickel.

16. The method of claim 12, wherein the powders form densified balled materials having a density of about 10 to 16 g/cm$^3$.

17. The method of claim 12, wherein the powders form densified balled materials having a density of about 10 to 13.5 g/cm$^3$.

18. The method of claim 12, further comprising sintering the densified balled materials.

19. The method of claim 18, further comprising sintering the densified balled materials in a first lower temperature stage and at a second higher temperature stage.

20. The method of claim 18, wherein the mechanical agitator comprises a rotating drum.

21. The method of claim 12, wherein the powders form densified balled materials at a rate of about 0.1 to 1 mm/hour.

22. A method of making ammunition projectiles, comprising:

providing a first mix of powdered components;

agglomerating said first mix of powdered components with a binding agent to form a pellet core having a first composition;

providing a second mix of powdered components;

agglomerating said second mix of powdered components with a binding agent to form a layer surrounding said pellet core having a second composition; and sintering the pellet core and the layer to produce said projectiles.

23. The method of claim 22, wherein the layer surrounding said pellet core is an intermediate layer, and further comprising:

providing a third mix of powdered components; and agitating said third mix of powdered components with a binding agent to form a surface layer surrounding said intermediate layer having a third composition;

wherein said sintering further comprising sintering said surface layer.

24. The method of claim 23, wherein the first composition and third composition are substantially the same.

25. The method of claim 23, wherein after sintering, the surface layer and the core are relatively softer than the intermediate layer.

26. The method of claim 23, wherein after sintering, the surface layer and the core have a density between about 8 and 10 g/cm$^3$ and the intermediate layer has a density between about 11 and 18 g/cm$^3$.

27. The method of claim 22, wherein the layer surrounding the pellet core is a surface layer.

28. The method of claim 27, wherein after sintering the surface layer has a density between about 8 and 10 g/cm$^3$ and the core has a density between about 11 and 18 g/cm$^3$.

29. The method of claim 22, wherein the first mix and the second mix comprise tungsten and at least one of iron, copper and nickel.

30. The method of claim 22, wherein the sintered projectiles form shots suitable for use in a shotgun shell.

31. The method of claim 22, wherein the pellet core and the layer surrounding the pellet core have different hardnesses.

32. A projectile produced in accordance with claim 22.

* * * * *